US005578435A

United States Patent [19]

Ihama

[11] Patent Number: 5,578,435

[45] Date of Patent: Nov. 26, 1996

[54] ENCASED PHOTOGRAPHIC MATERIAL

[75] Inventor: Mikio Ihama, Minami-ashigara, Japan

[73] Assignee: Fuji Photo Film Co., Ltd., Kanagawa, Japan

[21] Appl. No.: 441,497

[22] Filed: May 15, 1995

Related U.S. Application Data

[63] Continuation of Ser. No. 68,187, May 28, 1993.

[30] Foreign Application Priority Data

May 28, 1992 [JP] Japan ..... 4-160065

[51] Int. Cl.[6] ..... G03C 3/00; G03C 1/34; G03C 1/825; G03C 1/76

[52] U.S. Cl. ..... 430/501; 430/567; 430/607; 430/608; 430/612; 430/510; 430/523

[58] Field of Search ..... 430/347, 496, 430/501, 567, 607, 608, 612, 510, 523

[56] References Cited

U.S. PATENT DOCUMENTS

| | | | |
|---|---|---|---|
| 4,434,226 | 2/1984 | Wilgus et al. | 430/567 |
| 4,892,808 | 1/1990 | Harbison | 430/608 |
| 5,112,733 | 5/1992 | Ihama | 430/605 |
| 5,238,796 | 8/1993 | Maruyama et al. | 430/567 |
| 5,248,588 | 9/1993 | Nagoaka | 430/608 |

FOREIGN PATENT DOCUMENTS 0439069 7/1991 European Pat. Off. .

*Primary Examiner*—Mark F. Huff

*Attorney, Agent, or Firm*—Sughrue, Mion, Zinn, Macpeak & Seas

[57] ABSTRACT

An encased photographic material includes a silver halide light-sensitive material having at least one silver halide emulsion layer on a support. The emulsion layer contains gold- and chalcogen-sensitized silver halide grains and a thiocyanate salt therein. At least 60% of a total projected area of the silver halide grains is occupied by tabular grains having an aspect ratio of 3 or more and having on an average 10 or more dislocation lines per grain. A lightproof container contains the light-sensitive material such that an end portion of the light-sensitive material is positioned outside the lightproof container, and that a gas can pass between an inside and an outside of the lightproof container. A light-transmitting case encases and seals the lightproof container. A hydrogen cyanide gas scavenger is present inside the case.

15 Claims, 1 Drawing Sheet

ENCASED PHOTOGRAPHIC MATERIAL

This is a Continuation of application Ser. No. 08/068,187 filed May 28, 1993.

BACKGROUND OF THE INVENTION

1. Field of the Invention

The present invention relates to an encased photographic material and, more particularly, to an encased photographic material in which the storage stability of a silver halide photographic light-sensitive material encased in a light-transmitting case is improved.

2. Description of the Related Art

Silver halide photographic light-sensitive materials are sensitive to light. Therefore, such materials are generally shielded from light during storage before used in photographing. For example, the light-sensitive material is set in a lightproof container such as a magazine or cartridge, such as a film cartridge of 135-format color negative film. The cartridge containing the light-sensitive material is often encased in a light-transmitting or transparent case. The transparent case allows easy observation of the cartridge encased therein. Further, the transparent case can be conveniently reused as a case for keeping small articles.

Recently, a surprising phenomenon has been found: photographic film products placed on shelves in stores for long periods of time vary in film performance depending on brightness with which they are placed. An analysis of this phenomenon revealed that a certain kind of gas was generated by light incident on the leader portion of a film in a cartridge, through a paper box containing a transparent case encasing the cartridge and this gas diffused to a film portion shielded from light in the cartridge, changing the performance of the film. No such phenomenon has been conventionally known to those skilled in the art. To analyze this gas, a photographic film was forced to be irradiated with intense light and gas produced was collected. The gas was found to contain hydrogen cyanide gas.

Meanwhile, the present inventor has made extensive studies on an emulsion in which at least 60% of the total projected area of silver halide grains are occupied by tabular grains having an aspect ratio of 3 or more. A tabular grain has a large surface area and can therefore adsorb a large amount of sensitizing dyes. This increases a light absorption amount, resulting in an increased light sensitivity. In addition, a pressure-resistant property can be improved by introducing, on an average, 10 or more dislocation lines per grain. However, it is found that the presence of dislocation lines in tabular grains significantly increases the change in photographic performance due to irradiation with light. It is considered that this significant increase in change is due to the following two causes: the presence of dislocation lines in tabular grains increases an amount of halogen gas produced by print out; the presence of dislocation lines in tabular grains impairs the resistance of silver halide grains against hydrogen cyanide gas. These are serious problems in using tabular grains having dislocation lines. The deterioration caused by hydrogen cyanide gas is particularly significant when the grains are sensitized with gold and chalogen.

SUMMARY OF THE INVENTION

The present inventor believes that a reaction presented below takes place in a portion irradiated with light to produce hydrogen cyanide gas:

$$AgBr + h\nu \text{ (irradiation with light)} \longrightarrow 2Ag + Br_2 \text{ (printout)}$$

$$2\,AgSCN + Br_2 \longrightarrow 2AgBr + (SCN)_2$$

$$(SCN)_2 \xrightarrow{\text{hydrolysis}} HCN$$

It will be understood from this reaction formula that a scavenger for a halogen gas is also effective.

It is also predicted that an amount of hydrogen cyanide gas produced increases when the humidity is high.

It is therefore an object of the present invention to provide an encased photographic material in which the storage stability of a high-quality, high-sensitivity silver halide photographic light-sensitive material containing tabular grains with dislocation lines encased in a light-transmitting case is improved, by eliminating the adverse effect of hydrogen cyanide on a silver halide light sensitive material containing gold- and chalcogen-sensitized tabular grains with dislocation lines together with a thiocyanate.

According to the present invention, there is provided an encased photographic material comprising:

a silver halide light-sensitive material including at least one silver halide emulsion layer on a support, the emulsion layer containing gold- and chalcogen-sensitized silver halide grains and a thiocyanate salt therein, at least 60% of a total projected area of the silver halide grains being occupied by tabular grains having an aspect ratio of 3 or more, the tabular grains having on an average 10 or more dislocation lines per grain;

a lightproof container containing the light-sensitive material such that an end portion of the light-sensitive material is positioned outside the lightproof container, and that a gas can pass between an inside and an outside of the lightproof container;

a light-transmitting case encasing and sealing the lightproof container; and a hydrogen cyanide gas scavenger present inside the case.

In a preferred embodiment, the encased photographic material of the invention further comprises a halogen gas scavenger.

DETAILED DESCRIPTION OF THE PREFERRED EMBODIMENTS

Figure 1:
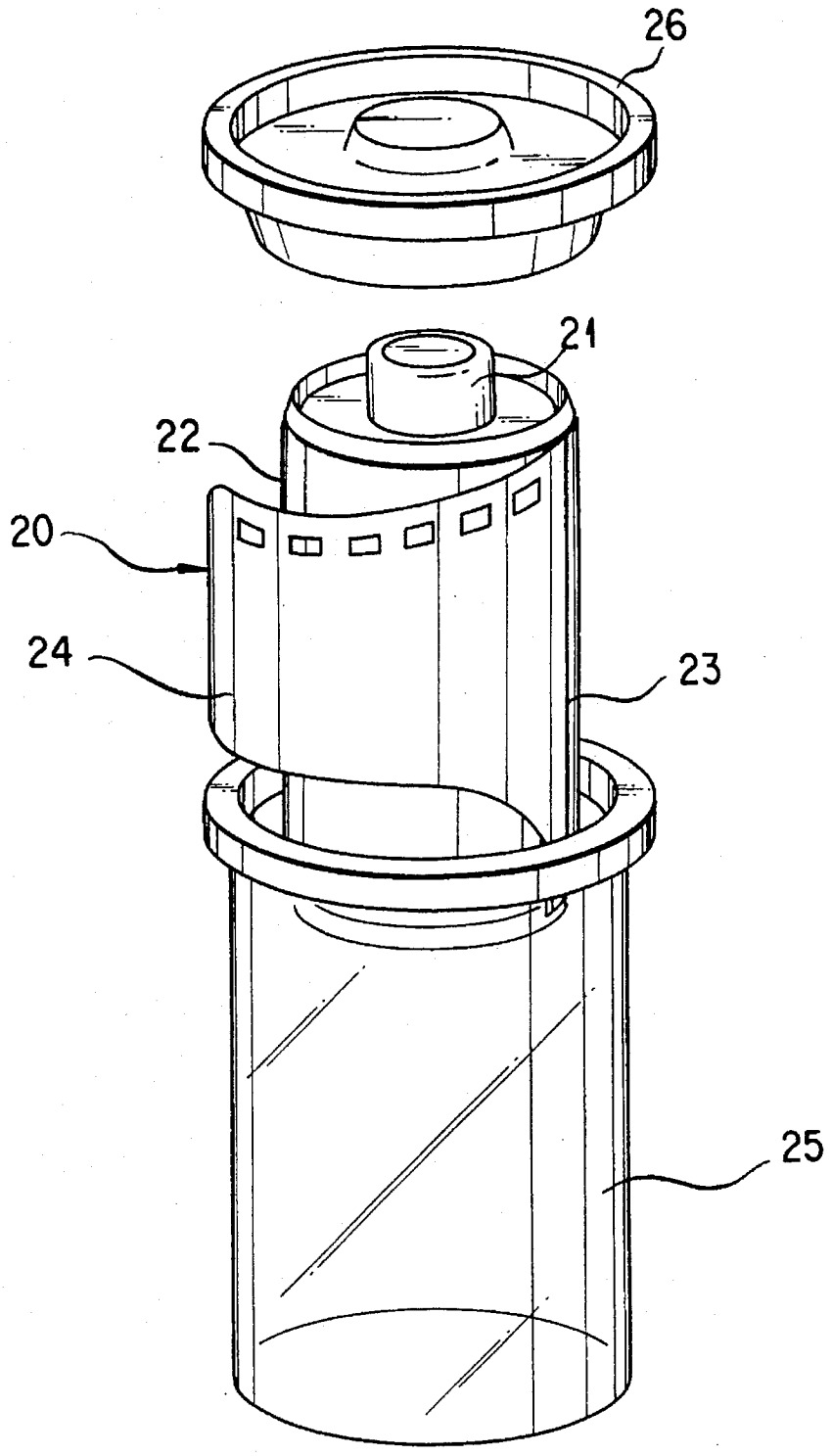
FIG. 1 is a perspective view showing a light-transmitting case encasing a silver halide light sensitive material contained in a lightproof container with its cap open.

The present invention will be described in detail below.

An encased photographic material of the present invention comprises a silver halide light-sensitive material including at least one silver halide emulsion layer on a support. The emulsion layer contains silver halide grains sensitized with gold and chalcogen, and a thiocyanate salt therein. At least 60% of a total projected area of the silver halide grains is occupied by tabular grains having an aspect ratio of 3 or more. Further the tabular grains have, on an average, 10 or more dislocation lines per grain.

The light-sensitive material is contained in a lightproof container such that an end portion of the light-sensitive material is positioned outside the lightproof container. Therefore, the end portion of the light-sensitive material is not shielded from light by the lightproof container. A gas can pass between an inside and an outside of the lightproof container.

The lightproof container containing the light-sensitive material is encased and sealed in a light-transmitting case.

The present invention provides means for eliminating adverse effect of hydrogen cyanide gas generated by light incident upon the unshielded end portion of the light-sensitive material. The generated hydrogen cyanide gas diffuses to the shielded portion of the light-sensitive material and deteriorates the performance of the light-sensitive material. More specifically, a hydrogen cyanide gas scavenger is present inside the light-transmitting case to capture the generated hydrogen cyanide gas.

If a silver halide is deteriorated to change its photographic performance under the influence of hydrogen cyanide gas, a scavenger for hydrogen cyanide gas is expected to be effective. JP-A-3-505263 discloses that compounds of palladium, gold, and platinum are effective as scavengers for hydrogen cyanide gas. It describes that fog resulting from hydrogen cyanide gas produced from carbon black can be prevented by adding a hydrogen cyanide gas scavenger to a position at which a light-sensitive emulsion can be protected from the gas. JP-A-3-505263 also describes that the addition position of a scavenger is preferably closer to carbon black, the source of the gas.

JP-A-3-505263 has, however, no description indicating that hydrogen cyanide gas is produced when light is radiated onto a light-sensitive material.

JP-A-3-505263, therefore, has, of course, no description indicating that hydrogen cyanide gas produced from a portion irradiated with light has an influence on photographic properties of a portion shielded from light.

Moreover, there is no description in JP-A-3-505263 that a thiocyanate salt contained in a light-sensitive material involves the generation of hydrogen cyanide gas.

As disclosed in, e.g., U.S. Pat. Nos. 2,566,245 and 2,566,263, addition of Pd compounds to silver halide photographic light-sensitive materials is a well-known conventional technique. In effect, addition of Pd to emulsion layers or interlayers of silver halide color photographic light-sensitive materials is widely put into practical use. For example, Kodacolor VR-G100 Brownie Film (EMUL. NO. 24 031 13) good through November, 1988, manufactured in the factory of Eastman Kodak Co., Rochester, N.Y., U.S.A., contains approximately $3\times10^{-5}$ g of Pd per a roll of film. This film is shielded from light by light-shielding black paper containing carbon black in an amount of about 8% (about 0.7 g per a roll of film) with respect to the weight of paper. So it is believed that the film is free from an influence of hydrogen cyanide gas produced upon irradiation with light.

It is impossible to predict that this Pd is effective against fog which is likely to occur when the same light-sensitive material as described above is made into a product with a film format having a portion exposed to light before photographing, such as those in the present invention.

A hydrogen cyanide gas scavenger according to the present invention is a compound that converts hydrogen cyanide gas, produced when a light-sensitive material is irradiated with light, into a photographically inert substance. The hydrogen cyanide gas scavenger of the present invention has no chemical sensitization effect. The scavenger should not release any substance having an adverse effect on silver halide light-sensitive materials, as a result of trapping of hydrogen cyanide gas. An appropriate hydrogen cyanide gas scavenger can be selected from inorganic or organic compounds of noble metals. Most preferred are compounds of palladium (II or IV) and platinum (II or IV). A compound of gold (I or III) is also preferable. Although compounds of rhodium (III), iridium (III or IV), and osmium (II, III, or IV) are also effective, a larger amount is required to obtain an equivalent effect when these compounds are used.

Practical examples of effective inorganic or organic noble metal compounds are described in detail in, e.g., Gmelin Handbook. These commercially available products, synthetic products, and in situ synthetic products must be used with purity with which they do not have any adverse effect on photographic light-sensitive materials.

Representative examples of useful palladium compounds are palladium (II) chloride, palladium (II) bromide, palladium (II) hydroxide, palladium (II) sulfate, palladium (II) thiocyanate, tetrachloropalladate (II) (sodium salt, potassium salt, and ammonium salt), hexachloropalladate(IV), tetrabromopalladate(II), hexabromopalladate(IV), bis(salicylato)palladate(II), bis(dithiooxalato-S,S')palladate(II), trans-dichlorobis(thioether)palladium(II), tetraamminepalladium(II) salt, dichlorodiamminepalladium(II), dibromodiamminepalladium(II), oxalatodiamminepalladium(II), dinitrodiaminepalladium(II), bis(ethylenediamine)palladium(II) salt, dichloroethylenediaminepalladium(II), bis(2,2'-bipyridine)palladium(II) salt, bis(1,10-phenanthroline)Palladium(II) salt, tetranitropalladate(II), bis(glycinato)palladium(II), tetrakis(thiocyanato)palladate(II), dichlorobis(phosphine)Palladium(II), di-μ-chloro-bis[chloro(phosphine)Palladium(II)], di-μ-chloro-bis[chloro(arsine) Palladium(II)], and dinitrobis(arsine)palladium(II).

Representative examples of useful platinum compounds are platinum(II) chloride, platinum(IV) chloride, hexafluoroplatinate(IV), tetrachloroplatinate(II), hexachloroplatinate(IV), trichlorotrifluoroplatinate(IV), tetrabromoplatinate(II), hexabromoplatinate(IV), dibromodichloroplatinate(II), hexahydroxoplatinate(IV), bis(oxalato)platinate(II), dichlorobis(oxalato)platinate(IV), bis(thiooxalato)platinate(II), bis(acetylacetonato)platinum(II), bis(1,1,1,5,5,5-hexafluoro-2,4-pentanedionato)platinum(II), bis(1,1,1-trifluoro-2,4-pentanedionato)platinum(II), tetrakis(thiocyanato)platinate(II), hexakis(thiocyanato)platinate(IV), bis{(Z)-1,2-dicyanoethylene-1,2-dithiolato}platinate(II), dichlorobis(diethylsulfido)platinum(II), tetrachlorobis(diethylsulfide)platinum(IV), bis(glycinato)platinum(II), dichloroglycinatoplatinate(II), dichlorobis(triethylphosphine)platinum(II), chlorohydridobis(triethylphosphine)platinum(II), tetraammineplatinum(II) salt, tetrachloroplatinate(II), dichlorodiammineplatinum(II), trichloroammineplatinum(II) salt, hexaammineplatinum(IV) salt, chloropentammineplatinum(IV) salt, tetrachlorodiammineplatinum(IV), dinitrodiammineplatinum(II), dichlorotetrakis(methylamine) platinum(IV) salt, dichloro(ethylenediamine)platinum(II), bis(ethylenediamine)platinum(II) salt, tris(ethylenediamine) platinum(IV) salt, dichlorobis(ethylenediamine) platinum(IV) salt, dichlorodihydroxo(ethylenediamine)platinum(IV), tetrakis(pyridine)platinum(II) salt, dichlorobis(pyridine)platinum(II), bis(2,2'-bipyridine)platinum(II) salt, tetranitroplatinate(II), chlorotrinitroplatinate(II), dichlorodinitroplatinate(II), dibromodinitroplatinate(II), hexanitroplatinate(IV), chloropentanitroplatinate(IV), dichlorotetranitroplatinate(IV), trichlorotrinitroplatinate(IV), trichlorodinitroplatinate(IV), dibromodichlorodinitroplatinate(IV), tetrachloro-(ethylene)platinate(II), di-μ-chloro-bis{chloro(ethylene)platinum(II)}, trans-dichloro(ethylene)(pyridine)platinum(II), bis[bis(β-mercaptoethylamine)nickel(II)-S,S'-]platinum (II) salt, and dichlorodicarbonylplatinum(II).

Examples of compounds of gold(I or III), rhodium(III), iridium(III or IV), and osmium(II, III, or IV) are potassium tetrachloroaurate(III), rhodium(III) chloride, potassium hexachloroiridate(IV), potassium tetrachloroiridate(III), and potassium hexachloroosmate(IV).

Inorganic or organic compounds of noble metals are not limited to the above examples as long as the effect of the present invention can be obtained.

In the present invention, the hydrogen cyanide gas scavenger can be present at any position inside the sealed case; the hydrogen cyanide gas scavenger can be coated on or incorporated in the inner surface of the sealed case or coated on or incorporated in a part forming a cartridge. Most preferably, the hydrogen cyanide gas scavenger is present in a photographic light-sensitive material. A photographic light-sensitive material is normally constituted by a support, a back layer, emulsion layers, surface protective layers, interlayers, and an antihalation layer. The hydrogen cyanide gas scavenger of the present invention is added directly to these layers and coated in the form of layers, or coated separately together with an appropriate solvent or binder.

As a method of adding the hydrogen cyanide gas scavenger to the light-sensitive material, methods normally used to add additives to photographic light-sensitive materials are applicable. For example, a water-soluble scavenger can be added in the form of an aqueous solution with a proper concentration. A scavenger which is insoluble or sparingly soluble in water can be dissolved in an appropriate organic solvent, such as alcohols, glycols, ketone, esters, or amides, that is miscible with water and has no adverse effect on photographic properties, and added in the form of a solution.

A back layer, emulsion layers, a surface protective layer, interlayers, and an antihalation layer are generally dispersions using binders. Examples of useful binders are a naturally produced polymeric vehicle, such as gelatin and a cellulose derivative, and a synthetic vehicle, such as polyvinyl alcohol and its derivative, acrylate and methacrylate polymers, and a butadienestyrene polymer and a similar substance. When the hydrogen cyanide gas scavenger is to be added directly to these layers, the conditions, such as the concentration and the pH of a binder must be selected carefully in accordance with the type and the amount of the hydrogen cyanide gas scavenger to be used.

Generally, a noble metal compound and gelatin interact, and this sometimes significantly raises the viscosity of the system depending on the conditions. For example, the interaction between palladium(II) ions and gelatin is described in detail in Journal of Japan Photographic Society, Vol. 34, page 159 (1971), Keiichi Tanaka; Journal of Japan Photographic Society, Vol. 37, page 133 (1974), Keiichi Tanaka; Journal of Japan Photographic Society, Vol. 39, page 73 (1976), Keiichi Tanaka; Journal of Photographic Science, vol. 21, page 134 (1973), Keiichi Tanaka; and Journal of Photographic Science, Vol. 26, page 222 (1978), Keiichi Tanaka.

Palladium(II) ions strongly bond with amide linkage and amino acid residues of gelatin, and hence sometimes form a bulk foreign matter of gelatin depending on the conditions. Therefore, it is preferable to select a proper palladium compound described above in accordance with the conditions.

In the present invention, the addition amount of the hydrogen cyanide gas scavenger must be so determined as to fall within a range over which the effect of the present invention can be obtained significantly. The addition amount is preferably 1/10 mol or more, more preferably ½ to 100 mol, and most preferably 1 to 10 mol per mol of thiocyanate contained in that portion of a silver halide light-sensitive material which may be irradiated with light within the case during storage or before photographing.

Silver halide emulsions of the present invention are subjected to gold sensitization and chalcogen sensitization. The chalcogen sensitization is performed by using at least one of selenium, sulfur, and tellurium sensitizers.

The selenium sensitization is performed by conventionally known methods. That is, the selenium sensitization is normally performed by adding a labile selenium compound and/or a non-labile selenium compound to an emulsion and stirring the emulsion at a high temperature, preferably 40° C. or more for a predetermined period of time. Selenium sensitization using the labile selenium compounds described in JP-B-44-15748 ("JP-B" means Published Examined Japanese Patent Application) is preferably performed. Practical examples of the labile selenium sensitizer are aliphatic isoselenocyanates, such as allylisoselenocyanate, selenoureas, selenoketones, selenoamides, selenocarboxylic acids and selenocarboxylate esters, and selenophosphates. Most preferable labile selenium compounds are as follows.

I. Colloidal metal selenium

II. Organic selenium compound (in which a selenium atom is double-bonded to a carbon atom of an organic compound by a covalent bond)

a. Isoselenocyanates Examples are aliphatic isoselenocyanates, such as allylisoselenocyanate.

b. Selenoureas (including an enol type) Examples are aliphatic selenourea, such as methyl, ethyl, propyl, isopropyl, butyl, hexyl, octyl, dioctyl, tetraoctyl, N-(β-carboxyethyl)-N',N'-dimethyl, N,N-diethyl, diethyl, and dimethyl selenoureas; aromatic selenourea having one or more aromatic groups such as phenyl and tolyl; and heterocyclic selenourea having a heterocyclic group such as pyridyl and benzothiazolyl.

c. Selenoketones Examples are selenoacetone, selenoacetophenone, selenoketone in which an alkyl group is bonded to >C=Se, and selenobenzophenone.

d. Selenoamides An example is selenoamide.

e. Selenocarboxylic acids and selenocarboxylate esters Examples are 2-selenopropionic acid, 3-selenobutylic acid, and methyl 3-selenobutyrate.

III. Others a. Selenides

Examples are diethylselenide, diethyldiselenide, and triphenylphosphineselenide.

b. Selenophosphates

Examples are tri-p-tolylselenophosphate and tri-n-butylselenophosphate.

Although preferable examples of the labile selenium compound are described above, the present invention is not limited to these examples. It is generally understood by those skilled in the art that the structure of a labile selenium compound used as a sensitizer for a photographic emulsion is not so important as long as selenium is labile, and that the organic part of the molecule of the selenium sensitizer has no important role except the role of carrying selenium and keeping it in a labile state in an emulsion. In the present invention, therefore, labile selenium compounds in this broad concept are advantageously used.

Selenium sensitization using non-labile selenium sensitizers described in JP-B-46-4553, JP-B-52-34491, and JP-B-52-34492 can also be used. The non-labile selenium compounds include selenious acid, potassium selenocyanide, selenazoles, quaternary ammonium salts of selenazoles, diarylselenide, diaryldiselenide, 2-selenazolidinedione, 2-selenoxazolidinethione, and derivatives of these compounds.

Non-labile selenium sensitizers and thioselenazolidinedione compounds described in JP-B-52-38408 are also useful.

These selenium sensitizers are dissolved in water, an organic solvent such as methanol or ethanol, or a solvent mixture of these solvents, and the resultant solution is added in performing chemical sensitization, preferably before start of chemical sensitization. A selenium sensitizer to be used is not limited to one type, but two or more types of the selenium sensitizers described above can be used together. A combination of the labile selenium compound and the non-labile selenium compound is preferable.

The addition amount of the selenium sensitizers used in the present invention varies depending on the activity of each selenium sensitizer used, the type or grain size of a silver halide, and the temperature and time of ripening. The addition amount, however, is preferably $1\times10^{-8}$ mol or more, and more preferably $1\times10^{-7}$ to $1\times10^{-4}$ mol per mol of a silver halide. When the selenium sensitizers are used, the temperature of chemical ripening is preferably 45° C. or more, and more preferably 50° C. to 80° C. The pAg and the pH can be set at any desired values. For example, the effect of the present invention can be obtained by a pH value over a broad range of 4 to 9.

In the present invention, the selenium sensitization can be performed more effectively in the presence of a silver halide solvent.

Examples of the silver halide solvent usable in the present invention are (a) organic thioethers described in U.S. Pat. Nos. 3,271,157, 3,531,289, and 3,574,628, JP-A-54-1019 ("JP-A" means Published Unexamined Japanese Patent Application), and JP-A-54-158917, (b) thiourea derivatives described in JP-A-53-82408, JP-A-55-77737, and JP-A-55-2982, (c) silver halide solvents having a thiocarbonyl group sandwiched between an oxygen or sulfur atom and a nitrogen atom, described in JP-A-53-144319, (d) imidazoles described in JP-A-54-100717, (e) sulfite salts, and (f) thiocyanates. Most preferable silver halide solvents are thiocyanate and tetramethylthiourea.

Although the amount of the silver halide solvent varies depending on the type of solvent, a preferable amount of, e.g., thiocyanate is $1\times10^{-4}$ to $1\times10^{-2}$ mol per mol of silver halide.

The sulfur sensitization is normally performed by adding a sulfur sensitizer to an emulsion and stirring the emulsion at a high temperature, preferably 40° C. or more for a predetermined time.

The gold sensitization is normally performed by adding a gold sensitizer to an emulsion and stirring the emulsion at a high temperature, preferably 40° C. or more for a predetermined time.

Sulfur sensitizers known to those skilled in the art can be used in the sulfur sensitization. Examples of the sulfur sensitizer are thiosulfate salts, allylthiocarbamidothioureas, allylisothiacyanate, cystine, p-toluenethiosulfonate salts, and rhodanine. It is also possible to use sulfur sensitizers described in, e.g., U.S. Pat. Nos. 1,574,944, 2,410,689, 2,278,947, 2,728,668, 3,501,313, and 3,656,955, German Patent 1,422,869, JP-B-56-24937, and JP-A-55-45016. The sulfur sensitizer is used in an amount sufficient to effectively increase the sensitivity of an emulsion. Although this amount varies over a wide range depending on various conditions such as the pH, the temperature, and the size of silver halide grains, it is preferably $1\times10^{-7}$ to $1\times10^{-4}$ mol per mol of a silver halide.

The gold sensitizer for use in the gold sensitization of the present invention can be any gold compound having an oxidation number of gold of +1 or +3, and it is possible to use gold compounds normally used as gold sensitizers. Representative examples of the gold sensitizer are chloroaurate, potassium chloroaurate, auric trichloride, potassium auricthiocyanate, potassium iodoaurate, tetracyanoauric acid, ammonium aurothiacyanate, and pyridyltrichlorogold.

Although the addition amount of the gold sensitizers varies depending on various conditions, it is preferably $1\times10^{-7}$ and $1\times10^{-4}$ mol per mol of silver halide.

As has been described above, photographic light-sensitive material according to the present invention has, on a support, a silver halide emulsion subjected to gold-chalcogen sensitization and containing a thiocyanate salt. Examples of the support are described in, e.g., RD. No. 17643; , page 28, RD. No. 18716, page 647, right column to page 648, left column, and RD. No. 307105, page 879.

The gold-chalcogen sensitization can be selected from gold-sulfur sensitization, gold-selenium sensitization, gold-tellurium sensitization, gold-sulfur-selenium sensitization, gold-sulfur-tellurium sensitization, gold-selenium-tellurium sensitization, and gold-sulfur-selenium-tellurium sensitization. The thiocyanate salt is used in any of these gold-chalcogen sensitizations. Preferable examples of the thiocyanate salt are an ammonium salt, a potassium salt, and a sodium salt.

The thiocyanate salt can be added either singly or in the form of a mixture with gold sensitizers in the gold-chalcogen sensitization. In addition, the thiocyanate salt can be added either in portions or continuously.

In the present invention, the thiocyanate salt is more preferably used not only in the gold-chalcogen sensitization, but in grain formation or desalting. The use of a thiocyanate salt during grain formation is described in U.S. Pat. Nos. 3,320,069 and 4,434,226.

A silver halide light-sensitive material of the present invention has an ISO sensitivity of preferably 100 to 3,200, and more preferably 400 to 3,200.

As has been pointed above, a halogen gas scavenger is also effective in eliminating the adverse effect of hydrogen cyanide produced light irradiation upon the light-sensitive material before photographing of the material.

The halogen gas scavenger of the invention is a compound that converts halogen gas, produced when a light-sensitive material is irradiated with light, into a photographically inert substance. The scavenger, therefore, should not release any substance having an adverse effect on silver halide light-sensitive materials, as a result of trapping of halogen gas.

It is generally known that gelatin acts as a halogen gas scavenger and its actions are the functions of the pH and the pAg of the system. In the present invention, however, it is preferable to use a compound given below as a halogen gas scavenger at a position inside the sealed case encasing the light-sensitive material. Preferred halogen scavengers are sulfide compounds, nitrite salts, semicarbazides, sulfite salts, hydroquinones, ethylenediamine, acetonesemicarbazone, and p-hydroxyphenylglycine. Particulary preferred halogen gas scavengers are those represented by Formula (H) below:

Formula (H)

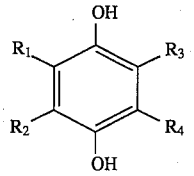

where each of $R_1$, $R_2$, $R_3$, and $R_4$ represents a hydrogen atom or a group substitutable on the benzene nucleus.

Preferable examples of the substituent in Formula (H) are a halogen atom (e.g., a fluorine atom, a chlorine atom, and a bromine atom), an alkyl group (most perferably one having 1 to 32 carbon atoms, e.g., methyl, ethyl, n-propyl, t-butyl, n-amyl, i-amyl, n-octyl, n-dodecyl, and n-octadecyl), an alkenyl group, an aryl group, an acyl group, a cycloalkyl group, an alkoxy group, an aryloxy group, an alkylthio group, an arylthio group, an alkylacylamino group, an arylacylamino group, an alkylcarbamoyl group, an arylcarbamoyl group, an alkylcarbonamido group, an arylcarbonamido group, an alkylsulfonamido group, an arylsulfonamido group, an alkylsulfamoyl group, an arylsulfamoyl group, an alkylsulfonyl group, an arylsulfonyl group, an alkyloxycarbonyl group, an aryloxycarbonyl group, an alkylacyloxy group, and an arylacyloxy group.

These substituent groups may be further substituted with substituents similar to those enumerated above.

The halogen gas scavenger of the present invention may be present either in a non-light-sensitive layer, such as a protective layer, an interlayer, or a back layer formed on a surface of film opposite to the emulsion surface, or a silver halide emulsion layer. The halogen gas scavenger is more preferably added to a layer formed on the emulsion layer side of a support and farther from the support.

The addition amount of the halogen gas scavenger is preferably 0.05 to 1 g/m$^2$, and more preferably 0.1 to 0.5 g/m$^2$.

Practical examples of a compound represented by Formula (H) are shown below.

(H-1)

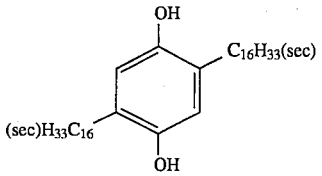

(H-2)

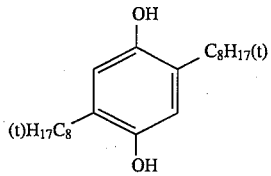

(H-3)

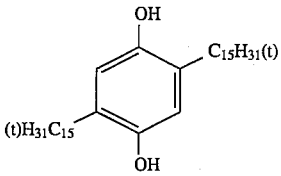

(H-4)

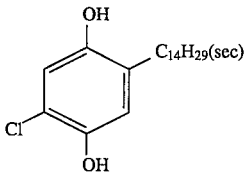

(H-5)

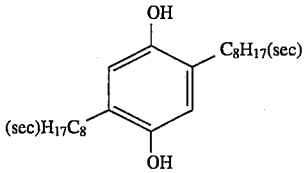

(H-6)

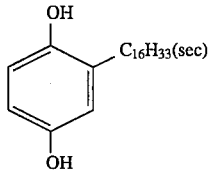

(H-7)

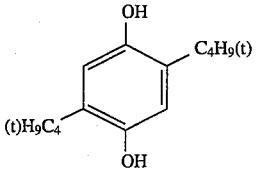

(H-8)

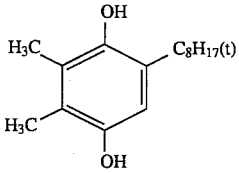

(H-9)

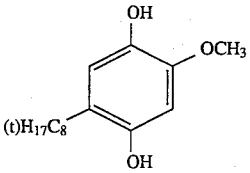

(H-10)

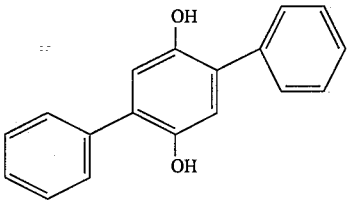

-continued (H-11)

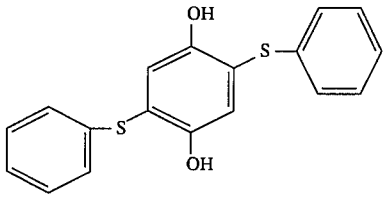

(H-12)

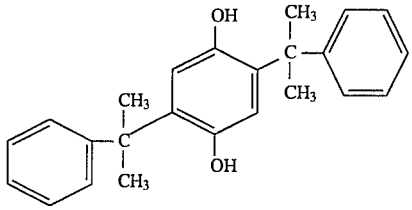

(H-13)

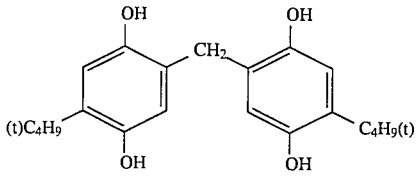

(H-14)

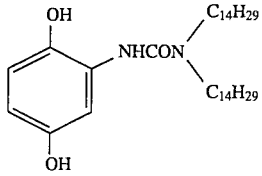

(H-15)

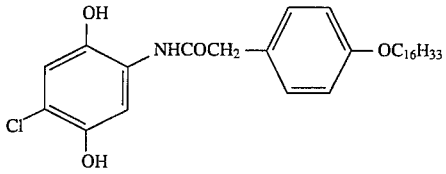

(H-16)

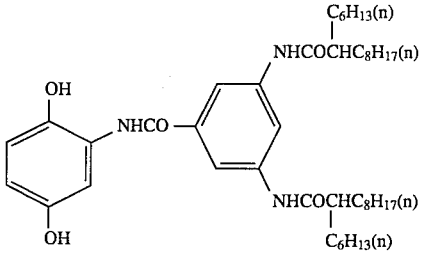

(H-18)

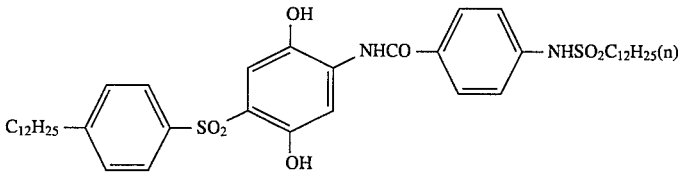

(H-19)

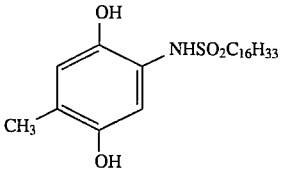

(H-20)

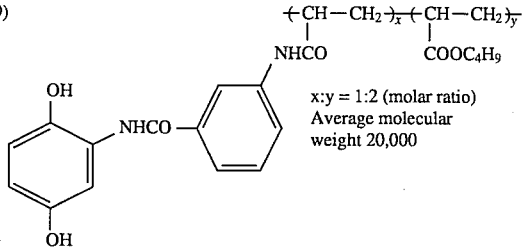

x:y = 1:2 (molar ratio)
Average molecular weight 20,000

In the encased photographic material according to the present invention, a photographic light-sensitive material is contained in a lightproof container such that an end portion of the light-sensitive material is located at a position at which it may be irradiated with light (outside the container) and the remaining portion is located at a position at which it is shielded from light (within the container). Air circulates through the portion to be irradiated with light and the portion to be shielded therefrom. The light-sensitive material contained in the lightproof container is encased in a light-transmitting case.

Although the lightproof container of the present invention includes a cassette for sheet film, it is typically a cartridge for roll film. The cartridge for roll film has a spool around which a silver halide light-sensitive material is wound into the form of a roll, a film slit through which the light-sensitive material is inserted and extracted, and a cartridge main body for housing the spool such that the spool is rotatable around the axis. The spool has a flange for shielding light: the flange prevents external light from entering the cartridge through a gap formed between a cap, which is arranged on one end portion of the cartridge main body, typically a cylindrical body portion, and the spool. It is also preferable to provide a light-shielding member at the film slit to allow smooth extraction and rewind of film. This light-shielding member is described in Published Examined Japanese Utility Model Application No. 61-34526.

A currently widely distributed 135-format roll film corresponds to a photographic material of this type. That is, as shown in FIG. 1, a silver halide photographic light-sensitive material 20 is contained in a metal cartridge 22 having a plastic spool 21 as its shaft and is in part extracted from a film extraction portion 23 via a light-shielding ribbon. For convenience of film loading, several centimeters of film are normally extracted, and this extracted portion 24 corresponds to the position which may be irradiated with light before photographing. Air circulates from the portion 24 to a portion to be shielded from light through the film extraction portion 23 or a gap formed in the cartridge 22.

The cartridge 22 containing the silver halide photographic light-sensitive material 20 is encased and sealed in a cartridge case 25 and a cap 26. The sealed case is so designed as to shield gas that is harmful to light-sensitive materials and suppress permeation of excess water vapor. However, the permeabilities to gas and water vapor largely depend on the structures and the materials of the cartridge case 25 and the cap 26.

The humidity inside the sealed case is preferably maintained constant. To obtain more advantageous effect of the present invention, a relative humidity inside the sealed case at 25° C. is preferably 55% or more, more preferably 55% to 70%, and most preferably 55% to 65%.

"The humidity inside the sealed case is maintained constant" means that when the difference in humidity between the atmosphere and the interior of the case is 20%, a change in humidity inside the case is 10% or less when the case is left to stand at 25° C. for 12 months.

The equilibrium humidity in the present invention is a value measured at 25° C. and can be measured by conventional methods (the equilibrium humidity can be measured by a capacitance humidity measurement device, such as a HUMICAP humidity sensor available from VAISALA K. K.)

In the present invention, the cartridge case 25 and/or the cap 26 is light-transmitting, i.e., transparent or semitransparent. "Transparent or semitransparent" means that the portion 24 extracted from the film extraction portion 23 may be exposed essentially to external light before photographing. More specifically, when the film is left to stand under radiation of light of 10,000 lux for 24 hours, an increase in fog in the portion 24 extracted from the film extraction portion 23 is 0.1 or more, preferably 0.3 or more, and more preferably 0.5 or more, or overall fog is caused.

Plastic materials for forming the transmitting case 25 or cap 26 can be manufactured by addition polymerization of an olefin having a carbon-carbon double bond, ring opening polymerization of a small number-membered cyclic compound, polycondensation (condensation polymerization) of two or more types of polyfunctional compounds, polyaddition, or addition condensation of a phenol derivative, a urea derivative or a melamine derivative with a compound having an aldehyde.

Representative examples of the olefin having a carbon-carbon double bond, as the raw material for forming the plastic material of the present invention, are styrene, α-methylstyrene, butadiene, methyl methacrylate, butyl acrylate, acrylonitrile, vinyl chloride, vinylidene chloride, vinylpyridine, N-vinylcarbazole, N-vinylpyrrolidone, vinylidene cyanide, ethylene, and propylene. Representative examples of the small number-membered cyclic compound are ethylene oxide, propylene oxide, glycidol, 3,3-bischloromethyloxetane, 1,4-dioxane, tetrahydrofuran, trioxane, ε-caprolactam, β-propiolactone, ethyleneimine, and tetramethylsiloxane.

Representative examples of the polyfunctional compound are carboxylic acids, such as terephthalic acid, adipic acid, and glutaric acid; isocyanates, such as toluenediisocyanate, tetramethylenediisocyanate, and hexamethylenediisocyanate; alcohols, such as ethyleneglycol, propyleneglycol, and glycerin; amines, such as hexamethylenediamine, tetramethylenediamine, and paraphenylenediamine; and epoxy. Representative examples of the phenol derivative, the urea derivative, and the melamine derivative are phenol, cresol, methoxyphenol, chlorophenol, urea, and melamine. Representative examples of the compound having an aldehyde are formaldehyde, acetaldehyde, octanal, dodecanal, and benzaldehyde. Two or more types of these raw materials can be used together in accordance with the target performance.

A catalyst or a solvent is sometimes used in the manufacture of the plastic material using these raw materials.

Examples of the catalyst are a free-radical polymerization catalyst, such as (1-phenylethyl)azodiphenylmethane, dimethyl-2,2'-azobisisobutylate, 2,2'-azobis(2-methylpropane), benzoylperoxide, cyclohexanone peroxide, and potassium persulfate; a cation polymerization catalyst, such as sulfuric acid, toluenesulfonic acid, trifluorosulfuric acid, perchloric acid, trifluoroboric acid, and tin tetrachloride; an anion polymerization catalyst, such as n-butyllithium, sodium/naphthalene, 9-fluorenyllithium, and phenylmagnesium bromide; a triethylaluminum/tetrachlorotitanium-based Ziegler-Natta catalyst; sodium hydroxide; potassium hydroxide; and a potassium metal.

The solvent is not particularly limited as long as it does not inhibit polymerization. Examples are hexane, decalin, benzene, toluene, cyclohexane, chloroform, acetone, methylethylketone, ethyl acetate, butyl acetate, and tetrahydrofuran.

In molding of plastic material, a plasticizer is mixed in plastic material as needed. Representative examples of the plasticizer are trioctylphosphate, tributylphosphate, dibutylphthalate, diethylsebacate, methylamylketone, nitrobenzene, γ-valerolactone, di-n-octylsuccinate, bromonaphthalene, and butylpalmitate.

Practical examples of the plastic material used in the present invention are shown below, but the material is not limited to these examples.

| | |
|---|---|
| P-1 | Polystyrene |
| P-2 | Polyethylene |
| P-3 | Polypropylene |
| P-4 | Polymonochlorotrifluoroethylene |
| P-5 | Vinylidene chloride resin |
| P-6 | Vinyl chloride resin |
| P-7 | Vinyl chloride-vinyl acetate copolymer resin |
| P-8 | Acrylonitrile-butadiene-styrene copolymer resin |
| P-9 | Methyl methacrylic resin |
| P-10 | Vinylformal resin |
| P-11 | Vinylbutyral resin |
| P-12 | Polyethylenephthalate |
| P-13 | Teflon |
| P-14 | Nylon |
| P-15 | Phenolic resin |
| P-16 | Melamine resin |

Examples of a plastic material most preferable for the present invention are polystyrene, polyethylene, and polypropylene.

In the present invention, silver halide grains of at least one silver halide emulsion layer on a support are tabular silver halide grains having an aspect ratio of 3 or more. The "tabular grain" is a general term of grains having one twin plane or two or more parallel twin planes. The twin plane is a (111) plane on both sides of which all ions at lattice points have a mirror image relationship to each other. when this tabular grain is viewed from the above, it looks like a triangle, a hexagon, or a circular triangle or hexagon. The triangular, hexagonal, and circular grains have parallel triangular, hexagonal, and circular outer surfaces, respectively.

In the present invention, the aspect ratio of a tabular grain is the value obtained by dividing the grain diameter of a tabular grain having that of 0.1 μm or more by the thickness of that grain. The thickness of a grain can be easily measured by depositing a metal together with a latex as a reference obliquely on a grain, measuring the length of the shadow of the latex in an electron micrograph, and calculating by referring to the length of the shadow of the latex.

In the present invention, the grain size is the diameter of a circle having an area equal to the projected area of parallel outer surfaces of a grain.

The projected area of a grain can be obtained by measuring the area in an electron micrograph and correcting the photographing magnification.

The diameter of the tabular grain is preferably 0.15 to 5.0 μm, and its thickness is preferably 0.05 to 1.0 μm.

An average aspect ratio can be obtained as an arithmetic mean of aspect ratios of at least 100 silver halide grains. The average aspect ratio can also be obtained as the ratio of the average thickness of grains to their average diameter.

In the emulsion layer of the present invention, tabular grains having an aspect ratio of 3 or more occupy 60% or more of the total projected area of all silver halide grains. The ratio of tabular grains is preferably 80% or more of the total projected area.

It is sometimes possible to obtain more preferable effects by using monodisperse tabular grains. Although the structure and the method of manufacturing monodisperse tabular grains are described in, e.g., JP-A-63-151618, the shape of the grains will be briefly described below. That is, a hexagonal tabular silver halide, in which the ratio of an edge having the maximum length with respect to the length of an edge having the minimum length is 2 or less, and which has two parallel faces as outer surfaces, accounts for 70% or more of the total projected area of silver halide grains. In addition, the grains have monodispersibility such that a variation coefficient of a grain size distribution of these hexagonal tabular silver halide grains (i.e., a value obtained by dividing a variation (standard deviation) in grain sizes, which are represented by equivalent-circle diameters of projected areas of the grains, by their average grain size) is 20% or less.

In the present invention, tabular grains have dislocation lines. Dislocation lines in tabular grains can be observed by a direct method performed at a low temperature using a transmission electron microscope, as described in, for example, J. F. Hamilton, Phot. Sci. Eng., 11, 57, (1967) or T. Shiozawa, J. Soc. Phot. Sci. Japan, 35, 213, (1972). That is, silver halide grains, extracted carefully from an emulsion so as not to apply a pressure at which dislocations are produced in the grains, are placed on a mesh for electron microscopic observation. Observation is performed by a transmission method while the sample is cooled to prevent damages (e.g., print out) due to electron rays. In this case, as the thickness of a grain is increased, it becomes more difficult to transmit electron rays through it. In this case, grains can be observed more clearly by using an electron microscope of a high voltage type (200 kv or more for a grain having a thickness of 0.25 μm). From photographs of grains obtained by the above method, it is possible to obtain the positions and the number of dislocations in each grain viewed in a direction perpendicular to the major faces of the grain.

The average number of dislocation lines is preferably 10 or more, and more preferably 20 or more per grain. If dislocation lines are densely present or cross each other, it is sometimes impossible to correctly count dislocation lines per grain. Even in these situations, however, dislocation lines can be roughly counted to such an extent as in units of 10 lines, making it possible to distinguish these grains from those in which obviously only a few dislocation lines are present. The average number of dislocation lines per grain is obtained as a number average by counting dislocation lines of 100 or more grains.

Dislocation lines can be introduced to, e.g., a portion near the peripheral region of a tabular grain. In this case, dislocations are substantially perpendicular to the peripheral region and produced from a position x% of the length between the center and the edge (peripheral region) of a tabular grain to the peripheral region. The value of x is preferably 10 to less than 100, more preferably 30 to less than 99, and most preferably 50 to less than 98. In this case, although a shape obtained by connecting the start positions of the dislocations is almost similar to the shape of the grain, it is not perfectly similar but sometimes distorted. Dislocations of this type are not found in the central region of a grain. The direction of dislocation lines is crystallographically, approximately a (211) direction. Dislocation lines, however, are often zigzagged and sometimes cross each other.

A tabular grain may have dislocation lines either almost uniformly across the whole peripheral region or at a particular position of the peripheral region. That is, in the case of a hexagonal tabular silver halide grain, dislocation lines may be limited to either portions near the six corners or only a portion near one of the six corners. In contrast, it is also possible to limit dislocation lines to only portions near the edges except for the portions near the six corners.

Dislocation lines can also be formed across a region including the centers of two parallel major faces of a tabular grain. When dislocation lines are formed across the entire region of the major faces, the direction of the dislocation lines is sometimes crystallographically, approximately a (211) direction with respect to a direction perpendicular to the major faces. In some cases, however, the direction is a (110) direction or random. The lengths of the individual dislocation lines are also random; the dislocation lines are sometimes observed as short lines on the major faces and sometimes observed as long lines reaching the edges (periphery). Although dislocation lines are sometimes straight, they are often zigzagged. In many cases, dislocation lines cross each other.

As described above, the position of dislocations may be either limited to a local position on the peripheral region or on the major faces or formed on both of them. That is, dislocation lines may be present on both the peripheral region and the major faces.

Introducing dislocation lines to the peripheral region of a tabular grain can be achieved by forming a specific silver iodide rich-layer inside the grain. The silver iodide-rich layer includes formation of a discontinuous silver iodide-rich region. More specifically, after a substrate grain is prepared, the silver iodiderich layer is formed and covered with a layer having a silver iodide content lower than that of the silver iodide-rich layer. The silver iodide content of the substrate tabular grain is lower than that of the silver iodide-rich layer, preferably 0 to 20 mol %, and more preferably 0 to 15 mol %.

The silver iodide-rich layer inside a grain means a silver halide solid solution containing silver iodide. This silver halide is preferably silver iodide, silver bromoiodide, or silver bromochloroiodide, and more preferably silver iodide or silver bromoiodide (silver iodide content 10 to 40 mol %). The silver iodide-rich layer inside a grain (to be referred to as an internal silver iodide-rich layer hereinafter) can be selectively formed on either the edge or the corner of a substrate grain by controlling the formation conditions of the substrate grain and the formation conditions of the internal silver iodide-rich layer. Important factors as the formation conditions of a substrate grain are the pAg (the logarithm of the reciprocal of a silver ion concentration), the presence/absence, the type, and the amount of a silver halide solvent, and the temperature. By controlling the pAg to 8.5 or less, more preferably 8 or less during growth of substrate grains, the internal silver iodide-rich layer can be selectively formed in portions near the corners of the substrate grain. On the other hand, by controlling the pAg to more than 8.5, more preferably 9 or more during growth of substrate grains, the internal silver iodide-rich layer can be formed on the edges of the substrate grain. The threshold value of pAg rises and falls depending on the temperature and the presence/absence, the type, and the amount of a silver halide solvent. When thiocyanate is used as the silver halide solvent, this threshold value of pAg shifts to the high-value side. The value of pAg at the end of growth of substrate grains is particularly important, among other pAg values during the growth. On the other hand, even if the pAg during growth does not meet the above value, the position of the internal silver iodide-rich layer can be controlled by performing ripening by controlling the pAg to the above proper value after the growth of substrate grains. In this case, ammonia, an amine compound, a thiourea derivative, or thiocyanate salt can be effectively used as the silver halide solvent. The formation of the internal silver iodide-rich layer can be performed by a so-called conversion method. This method includes a method in which, at a certain point during grain formation, halogen ions which forms a silver salt having a solubility lower than the silver salt forming grains or portions near the surfaces of grains at that point, is added. In the present invention, it is preferable that the amount of halogen ions for forming a silver salt having a smaller solubility take a certain value (associated with a halogen composition) with respect to the surface area of grains at that point. For example, at a given point during grain formation, it is preferable to add KI in a certain amount or more with respect to the surface area of silver halide grains at that point. More specifically, it is preferable to add $8.2\times10^{-5}$ mol/m$^2$ or more of iodide salt.

A more preferable method of forming the internal silver iodide-rich layer is to add an aqueous silver salt solution simultaneously with addition of an aqueous silver halide solution containing iodide salt.

AS an example, an aqueous $AgNO_3$ solution is added simultaneously with addition of an aqueous KI solution by a double-jet method. In this case, the addition start timings and the addition end timings of the aqueous KI solution and the aqueous $AgNO_3$ solution may be shifted from each other. The addition molar ratio of the aqueous $AgNO_3$ solution to the aqueous KI solution is preferably 0.1 or more, more preferably 0.5 or more, and most preferably 1 or more. The total addition molar quantity of the aqueous $AgNO_3$ solution may exit in a silver excess region with respect to the halogen ions in the system and iodine ion added. During the addition of the aqueous silver halide solution containing iodine ions and the addition of the aqueous silver salt solution by the double-jet method, the pAg preferably decreases with the addition time of double-jet. The pAg before the addition is preferably 6.5 to 13, and more preferably 7.0 to 11. The pAg at the end of addition is most preferably 6.5 to 10.0.

In carrying out the above method, the solubility of a silver halide in the system is preferably as low as possible. Therefore, the temperature of the system, at which the silver iodide-rich layer is formed, is preferably 30° C. to 80° C., and more preferably 30° C. to 70° C.

The formation of the internal silver iodide-rich layer is most preferably performed by adding fine grain silver iodide (which means fine silver iodide; the same shall apply hereinafter), fine grain silver bromoiodide, fine grain silver iodochloride, or fine grain silver bromochloroiodide. The addition of fine grain silver iodide is particularly preferable. These fine grains normally have a grain size of 0.01 to 0.1 μm, but those having a grain size of 0.01 μm or less or 0.1 μm or more can also be used. Methods of preparing these fine silver halide grains are described in JP-A-1-183417, JP-A-2-44335, JP-A-1-183644, JP-A-1-183645, JP-A-2-43534, and JP-A-2-43535. The internal silver iodide-rich layer can be formed by adding these fine silver halide grains and performing ripening. In dissolving the fine grains by ripening, the silver halide solvent described above can also be used. These fine grains added need not immediately, completely dissolve to disappear but need only disappear by dissolution when the final grains are completed.

The internal silver iodide-rich layer is located in a region from the center of, e.g., a hexagon, obtained by projecting a grain, to a position at which a silver amount is preferably 5 to less than 100 mol %, more preferably 20 to less than 95 mol %, and most preferably 50 to less than 90 mol % with respect to the total silver amount of the grain. In addition, the amount of a silver halide that forms the internal silver iodide-rich layer is, as a silver amount, preferably 50 mol % or less, and more preferably 20 mol % or less of the total silver amount of a grain. These values of amounts of the silver iodide-rich layer are not those obtained by measuring the halogen composition of the final grain by using various analysis methods but formulated values in the manufacture of a silver halide emulsion. The internal silver iodide-rich layer often disappears from the final grain owing to, e.g., recrystallization, and so the above description relates entirely to the manufacturing method.

It is, therefore, easy to observe dislocation lines in the final grains by the above method, but the internal silver iodide-rich layer formed to introduce dislocation lines often cannot be observed as a definite layer. For example, the entire peripheral region of a tabular grain is sometimes observed as the silver iodide-rich layer. These halogen compositions can be checked by combining X-ray diffraction, an EPMA (also called an XMA) method (method of scanning a silver halide grain by electron rays to detect its silver halide composition), and an ESCA (also called an XPS) method (method of radiating X-rays to spectroscopically detect photoelectrons emitted from the surface of a grain).

The silver iodide content of an outer layer covering the internal silver iodide-rich layer is lower than that of the silver iodide-rich layer, preferably 0 to 30 mol %, more preferably 0 to 20 mol %, and most preferably 0 to 10 mol %.

Although the temperature and the pAg, at which the outer layer covering the internal silver iodide-rich layer is formed, can take arbitrary values, the temperature is preferably 30° C. to 80° C., and most preferably 35° C. to 70° C., and the pAg is preferably 6.5 to 11.5. The use of the silver halide solvents described above is sometimes preferable, and the most preferable silver halide solvent is a thiocyanate salt.

Another method of introducing dislocation lines to tabular grains is to deposit a silver halochloride after preparation of substrate grains, causing the deposited silver halochloride to form a silver bromide or silver iodide rich-layer through conversion, and forming a shell outside the layer. Examples of the silver halochloride are silver chloride, silver chlorobromide containing 10 mol % or more, preferably 60 mol % or more of silver chloride, and silver bromochloroiodide. These silver halochlorides can be deposited on substrate grains by adding an aqueous silver nitrate solution and an aqueous solution of an appropriate alkali metal salt (e.g., potassium chloride) either separately or simultaneously, or by adding an emulsion consisting of these silver salts and performing ripening. Although the deposition of these silver halochlorides is possible in any pAg region, the pAg is most preferably 5.0 to 9.5. The amount of the silver halochloride layer, as an amount of silver, is preferably 1 to 80 mol %, and more preferably 2 to 60 mol % with respect to a substrate grain. Dislocation lines can be introduced to a tabular grain by performing conversion for this silver halochloride layer with an aqueous halide solution capable of forming a silver salt with solubility lower than that of the silver halochloride. For example, the final grain can be formed by performing conversion for this silver halochloride layer with an aqueous KI solution and then growing a shell. This halogen conversion of the silver halochloride layer does not mean that the silver halochloride is entirely replaced with a silver salt having solubility lower than that of the silver halochloride, but means that preferably 5% or more, more preferably 10% or more, and most preferably 20% or more of the silver halochloride are replaced with the silver salt having a lower solubility. Dislocation lines can be introduced to a particular position on a major face by controlling the halogen structure of a substrate grain on which the silver halochloride layer is to be formed. For example, the use of a tabular substrate grain with an internal silver iodide-rich structure, which is displaced in the lateral direction of the substrate grain, makes it possible to introduce dislocation lines only to a peripheral portion of a major face except its central portion. It is also possible to introduce dislocation lines only to a central portion of a major face except its peripheral portion by using a tabular substrate grain with an outside silver iodide rich-structure, which is displaced in the lateral direction of the substrate grain. In addition, the use of a site director, such as an iodide, for epitaxial growth of a silver halide makes it possible to deposit a silver halochloride only on a portion limited in area, thereby introducing dislocation lines only to that portion. The temperature during deposition of a silver halochloride is preferably 30° C. to 70° C., and more preferably 30° C. to 50° C. Although it is possible to perform conversion after the deposition of the silver halochloride and then grow a shell, the halogen conversion can also be performed simultaneously with the growth of the shell after the deposition of the silver halochloride.

The internal silver halochloride layer is located in a region from the center of a grain to a position at which a silver amount is preferably 5 to less than 100 mol %, more preferably 20 to less than 95 mol %, and most preferably 50 to less than 90 mol % with respect to the total silver amount of the grain.

The silver iodide content of a shell is preferably 0 to 30 mol %, and more preferably 0 to 20 mol %. Although the temperature and the pAg during the shell formation can take given values, the temperature is preferably 30° C. to 80° C., and most preferably 35° C. to 70° C., and the pAg is preferably 6.5 to 11.5. It is sometimes favorable to use the silver halide solvents described above. The most preferable silver halide solvent is a thiocyanate salt. It is sometimes impossible to observe, in the final grain, the internal silver halochloride layer subjected to halogen conversion by the halogen composition analysis methods described above depending on the conditions, such as the degree of halogen conversion. Dislocation lines, however, can be clearly observed.

Dislocation lines can also be introduced by properly combining this method of introducing dislocation lines with the method of introducing dislocation liens mentioned earlier.

In a silver halide emulsion used in the present invention, any of silver bromide, silver bromoiodide, silver bromochloroiodide, and silver chlorobromide can be used in combination with the tabular grains having dislocation lines. A preferable silver halide is silver bromoiodide or silver bromochloroiodide each containing 30 mol % or less of silver iodide.

Tabular grains of the present invention can be prepared by the methods described in, e.g., Cleve, Photography Theory and Practice (1930), page 131; Gutoff, Photographic Science and Engineering, Vol. 14, pages 248 to 257, (1970); and U.S. Pat. Nos. 4,434,226, 4,414,310, 4,433,048, and 4,439,520, and British Patent 2,112,157.

Silver halide emulsions are normally subjected to chemical sensitization. The chemical sensitization can be performed by, e.g., the methods described in H. Frieser ed., "Die Grundlagen der Photographischen Prozesse mit Silberhalogeniden," Akademische Verlags Gesellschaft, pages 675 to 734.

That is, the methods are a sulfur sensitization method using compounds containing sulfur (e.g., thiosulfates, thioureas, mercapto compounds, and rhodanines), which can react with inert gelatin or silver; a reduction sensitization method using reducing substances (e.g., stannous chloride, amines, a hydrazine derivative, formamidinesulfinic acid, and a silane compound); a noble metal sensitization method using noble metal compounds (e.g., gold complex salt and complex salts of metals in the eighth column of the periodic table, such as Pt, Ir, and Pd); and a selenium sensitization method using selenium compounds (e.g., selenoureas, selenoketones, selenides, and selenophosphates). These methods can be used either singly or together.

Photographic emulsions used in the present invention may contain various compounds in order to prevent fog during the manufacturing process, storage, or photographic treatments of a light-sensitive material, or to stabilize photographic properties. Usable compounds are those known as an antifoggant or a stabilizer, for example, azoles, such as benzothiazolium salt, nitroindazoles, triazoles, benzotriazoles, and benzimidazoles (particularly a nitro- or halogen-substituted compound); heterocyclic mercapto compounds, such as mercaptothiazoles, mercaptobenzothiazoles, mecaptobenzimidazoles, mercaptothiadiazoles, mercaptotetrazoles (particularly 1-phenyl-5-mercaptotetrazole), and mercaptopyrimidines; the above heterocyclic mercapto compounds having a water-soluble group, such as a carboxyl group or a sulfone group; a thioketo compound such as oxazolinethione; azaindenes, such as tetrazaindenes (particularly 4-hydroxy-substituted(1,3,3a,7)tetrazaindenes); benzenethiosulfonic acids; and benzenesulfinic acids.

These antifoggants or stabilizers are normally added after chemical sensitization, and, more preferably, during or before chemical ripening. That is, the addition timing can be any of during addition of a silver salt solution, after the addition of a silver salt solution and before chemical ripening, and during the chemical ripening (before a time period of preferably 50%, and more preferably 20% of the entire chemical ripening time elapses from the start of the chemical ripening), in the process of forming silver halide emulsion grains.

Although the addition amount of the above compounds cannot be determined unconditionally because it depends on the addition method or the silver halide amount, it is preferably $10^{-7}$ to $10^{-2}$ mol, and more preferably $10^{-5}$ to $10^{-2}$ mol per mol of silver halide.

In the present invention, gelatin can be advantageously used as a preservative (binder or protective colloid) for photographic emulsions. However, hydrophilic colloid other than gelatin can also be used.

Examples of the hydrophilic colloid are protein, such as a gelatin derivative, a graft polymer of gelatin and another high polymer, albumin, and casein; a sugar derivative, such as a cellulose derivative, e.g., hydroxyethylcellulose, carboxymethylcellulose, and cellulose sulfates, sodium alginate, and a starch derivative; and a variety of synthetic hydrophilic high polymers, such as homopolymers or copolymers, e.g., polyvinyl alcohol, polyvinyl alcohol partial acetal, poly-N-vinylpyrrolidone, polyacrylic acid, polymethacrylic acid, polyacrylamide, polyvinylimidazole, and polyvinyl pyrazole.

Examples of gelatin are lime-processed gelatin, acid-processed gelatin, and enzyme-processed gelatin described in Bull. Soc. Sci. Photo. Japan. No. 16, page 30 (1966). In addition, a hydrolyzed product or an enzyme-decomposed product of gelatin can also be used. Examples of the gelatin derivative are those obtained by reacting gelatin with various compounds, such as acid halide, acid anhydride, isocyanates, bromoacetic acid, alkanesaltons, vinylsulfonamides, maleinimide compounds, polyalkyleneoxides, and epoxy compounds.

Practical examples of a dispersion medium used in the present invention are described in Research Disclosure (RD), Vol. 176, No. 17643 (December, 1978), page IX.

Photographic emulsions used in the present invention may be subjected to spectral sensititation by methine dyes and the like. Usable dyes include a cyanine dye, a merocyanine dye, a composite cyanine dye, a composite merocyanine dye, a holopolar cyanine dye. a hemicyanine dye, a styryl dye, and a hemioxonole dye. Most useful dyes are those belonging to a cyanine dye, a merocyanine dye, and a composite merocyanine dye. Any nucleus commonly contained as a basic heterocyclic nucleus in cyanine dyes can be contained in these dyes. Examples of an applicable nucleus are a pyrroline uncleus, an oxazoline uncleus, a thiozoline nucleus, a pyrrole nucleus, an oxazole nucleus, a thiazole nucleus, a selenazole nucleus, an imidazole nucleus, a tetrazole nucleus, and pyridine nucleus; a nucleus in which an aliphatic hydrocarbon ring is fused to any of the above nuclei; and a nucleus in which an aromatic hydrocarbon ring is fused to any of the above nuclei, e.g., an indolenine nucleus, a benzindolenine uncleus, an indole nucleus, a benzoxazble nucleus, a naphthoxazole nucleus, a benzthiazole nucleus, a naphthothiazole nucleus, a benzoselenazole nucleus, a benzimidazole nucleus, and a quionoline nucleus. These nuclei may have a substitute on a carbon atom.

It is possible for a merocyanine dye or a composite merocyanine dye to have a 5- to 6-membered heterocyclic nucleus as a nucleus having a ketomethylene structure. Examples are a pyrazolin-5-one nucleus, a thiohydantoin nucleus, a 2-thiooxazolidin-2,4-dione nucleus, a thiazolidin-2,4-dione nucleus, a rhodanine nucleus, and a thiobarbituric acid nucleus.

Although these sensitizing dyes may be used singly, they can also be used together. The combination of sensitizing dyes is often used for a supersensitization purpose. Representative examples of the combination are described in U.S. Pat. Nos. 2,688,545, 2,977,299, 3,397,060, 3,522,052, 3,527,641, 3,617,293, 3,628,964. 3,666,480, 3,672,898, 3,679,428, 3,703,377, 3,769,301, 3,814,609, 3,837,862, and 4,026,707, British Patents 1,344,281 and 1,507,803, JP-B-43-4936, JP-B-53-12375, JP-A-52-110618, and JP-A-100925.

The emulsions used in the present invention may contain, in addition to the sensitizing dyes, dyes having no spectral sensitizing effect or substances not essentially absorbing visible light and presenting supersensitization.

The sensitizing dyes can be added to an emulsion at any point in preparation of an emulsion, which is conventionally known to be useful. Most ordinarily, the addition is performed after completion of chemical sensitization and before coating. However, it is possible to perform the addition at the same time as addition of chemical sensitizing dyes to perform spectral sensitization and chemical sensitization simultaneously, as described in U.S. Pat. Nos. 3,628,969 and 4,225,666. It is also possible to perform the addition prior to chemical sensitization, as described in JP-A-58-113928, or before completion of formation of a silver halide grain precipitation to start spectral sensitization. Alternatively, as disclosed in U.S. Pat. No. 4,225,666, these dyes described above can be added separately: a portion of the dyes may be added prior to chemical sensitization, while the remaining portion is added after that. That is, the dyes can be added at any time during formation of silver halide grains, including the method disclosed in U.S. Pat. No. 4,183,756.

The addition amount of the sensitizing dye may be $4\times10^{-6}$ to $8\times10^{-3}$ mole per mole of silver halide. However, for a more preferable silver halide grain size of 0.2 to 1.2 μm, an addition amount of about $5\times10^{-5}$ to $2\times10^{-3}$ mole per mole of silver halide is more effective.

The light-sensitive material of the present invention may contain the various additives noted above, but other additives may be used in accordance with purposes.

These additives are described in detail in Research Disclosure (RD) Item 17648 (December 1978) and RD Item 18716 (November 1974) and are summarized below:

| Additives | RD17643 | RD18716 |
|---|---|---|
| 1. Chemical sensitizers | page 23 | page 648, right column |
| 2. Sensitivity-increasing agents | | page 648, right column |
| 3. Spectral sensitizers, super-sensitizers | pp. 23–24 | page 648, right column to page 649, right column |
| 4. Brighteners | page 24 | page 648, right column |
| 5. Antifoggants, stabilizers | pp. 24–25 | page 649, right column |
| 6. Light absorbent, filter dye, ultra-violet absorbents | pp. 25–26 | page 649, right column to page 650, left column |
| 7. Stain-preventing agents | page 25, right column | page 650, left-right columns |
| 8. Dye image-stabilizer | page 25 | page 650, left column |
| 9. Hardening agents | page 26 | page 651, left column |
| 10. Binder | page 26 | page 651, left column |
| 11. Plasticizers, lubricants | page 27 | page 650, right column |
| 12. Coating aids, surface active agents | pp. 26–27 | page 650, right column |
| 13. Antistatic agents | page 27 | page 650, right column |

Various color couplers can be used in the present invention, and specific examples of these couplers are described in patents described in the above-mentioned RD No. 17643, VII-C to VII-G and RD No. 307105, VII-C to VII-G.

Preferable examples of yellow couplers are described in, e.g., U.S. Pat. Nos. 3,933,501; 4,022,620; 4,326,024 and 4,401,752, JP-B-58-10739, British Patents 1,425,020 and 1,476,760.

Examples of a magenta coupler are preferably 5-pyrazolone type and pyrazoloazole type compounds, and more preferably, compounds described in, for example, U.S. Pat. Nos. 4,310,619 and 4,351,897, European Patent 73,636, U.S. Pat. Nos. 3,061,432 and 3,725,067, RD No. 24220 (June 1984), JP-A-60-33552, RD No. 24230 (June 1984), JP-A-60-43659, JP-A-61-72238, JP-A-60-35730, JP-A-55-

118034, JP-A-60-185951, and U.S. Pat. Nos. 4,500,630 and 4,540,654.

Examples of a cyan coupler are phenol type and naphthol type ones. Of these, preferable are those described in, for example, U.S. Pat. Nos. 4,052,212; 4,146,396; 4,228,233; 4,296,200; 2,369,929; 2,801,171; 2,772,162; 2,895,826; 3,772,002; 3,758,308; 4,343,011 and 4,327,173, West German Patent Laid-open Application 3,329,729, European Patents 121,365A and 249,453A, U.S. Pat. Nos. 3,446,622; 4,333,999; 4,451,559 and 4,427,767 and European Patent 161,626A.

Preferable examples of a colored coupler for correcting unnecessary absorption of a colored dye are those described in RD No. 17643, VII-G, RD No. 30715, VII-G, U.S. Pat. No. 4,163,670, JP-B-57-39413, U.S. Pat. Nos. 4,004,929 and 4,138,258, and British Patent 1,146,368.

Preferable examples of a coupler capable of forming colored dyes having proper diffusibility are those described in U.S. Pat. No. 4,366,237, British Patent 2,125,570, European Patent 96,570, and West German Laid-open Patent Application No. 3,234,533.

Typical examples of a polymerized dye-forming coupler are described in, e.g., U.S. Pat. Nos. 3,451,820; 4,080,211; 4,367,282; 4,409,320 and 4,576,910, British Patent 2,102,173, and European Patent 341,188A.

Those couplers which release a photographically useful residue upon coupling may also be preferably used in the present invention. DIR couplers, i.e., couplers releasing a development inhibitor, are preferably those described in the patents cited in the above-described RD No. 17643, VII-F, JP-A-57-151944, JP-A-57-154234, JP-A-60-184248, and U.S. Pat. No. 4,248,962.

Preferable examples of a coupler which imagewise releases a nucleating agent or a development accelerator are those described in British Patents 2,097,140 and 2,131,188, JP-A-59-157638, and JP-A-59-170840.

Examples of other couplers which can be used in the light-sensitive material of the present invention are competing couplers described in, for example, U.S. Pat. No. 4,130,427; poly-equivalent couplers described in, e.g., U.S. Pat. Nos. 4,283,472, 4,338,393, and 4,310,618; a DIR redox compound releasing coupler, a DIR coupler releasing coupler, a DIR coupler-releasing coupler or a DIR redox-releasing coupler described in, for example, JP-A-60-185950 and JP-A-62-24252; couplers releasing a dye which restores color after being released described in European Patent 173,302A and 313,308A; a bleaching accelerator-releasing coupler described in RD No. 11449, RD 24241 and JP-A-61-201247; and a ligand-releasing coupler described in, e.g., U.S. Pat. No. 4,553,477.

The couplers for use in this invention can be introduced into the light-sensitive material by various known dispersion methods.

Examples of a high-boiling point organic solvent to be used in the oil-in-water dispersion method are described in, e.g., U.S. Pat. No. 2,322,027. Examples of a high-boiling point organic solvent to be used in the oil-in-water dispersion method and having a boiling point of 175° C. or more at atmospheric pressure are phthalic esters (e.g., dibutylphthalate, dicyclohexylphthalate, di-2-ethylhexylphthalate, decylphthalate, bis(2,4-di-t-amylphenyl) phthalate, bis(2,4-di-t-amylphenyl) isophthalate, bis(1,1-di-ethylpropyl) phthalate), phosphate or phosphonate esters (e.g., triphenylphosphate, tricresylphosphate, 2-ethylhexyldiphenylphosphate, tricyclohexylphosphate, tri-2-ethylhexylphosphate, tridodecylphosphate, tributoxyethylphosphate, trichloropropylphosphate, and di-2-ethylhexylphenylphosphonate), benzoate esters (e.g., 2-ethylhexylbenzoate, dodecylbenzoate, and 2-ethylhexyl-p-hydroxybenzoate), amides (e.g., N,N-diethyldodecaneamide, N,N-diethyllaurylamide, and N-tetradecylpyrrolidone), alcohols or phenols (e.g., isostearyl alcohol and 2,4-di-tert-amylphenol), aliphatic carboxylate esters (e.g., bis(2-ethylhexyl) sebacate, dioctylazelate, glyceroltributyrate, isostearyllactate, and trioctylcitrate), an aniline derivative (e.g., N,N-dibutyl-2-butoxy-5-tertoctylaniline), and hydrocarbons (e.g., paraffin, dodecylbenzene, and diisopropylnaphthalene). An organic solvent having a boiling point of about 30° C. or more, and preferably, 50° C. to about 160° C., can be used as an auxiliary solvent. Typical examples of the auxiliary solvent are ethyl acetate, butyl acetate, ethyl propionate, methylethylketone, cyclohexanone, 2-ethoxyethylacetate, and dimethylformamide.

Steps and effects of a latex dispersion method and examples of a immersing latex are described in, e.g., U.S. Pat. No. 4,199,363 and German Laid-open Patent Application (OLS) Nos. 2,541,274 and 2,541,230.

The present invention can be applied to various color light-sensitive materials. Typical examples of the material are a color negative film for a general purpose, and a color reversal film for a slide.

The light-sensitive material used in the present invention may be color photographic light-sensitive materials, including those having various arrangements and those using combinations of layer arrangements and special color materials.

Representative examples are light-sensitive materials using combinations of the coupling rates or the diffusion properties of color couplers and the layer arrangements, such as those described in JP-B-47-49031, JP-B-49-3843, JP-B-50-21248, JP-A-59-58147, JP-A-59-60437, JP-A-60-227256, JP-A-61-4043, JP-A-61-43743, and JP-A-61-42657; light-sensitive materials in which a layer sensitive to a certain color is divided into two or more layers, such as those described in JP-B-49-15495 and U.S. Pat. No. 3,843,469; and light-sensitive materials in which the arrangements of high-speed layers and low-speed layers or the arrangements of layers sensitive to different colors are defined, such as those described in JP-B-53-37017, JP-B-53-37018, JP-A-51-49027, JP-A-52-143016, JP-A-53-97424, JP-A-53-97831, JP-A-62-200350, and JP-A-59-177551.

Proper supports usable in the present invention are described in, e.g., RD. No. 17643, page 28 and RD No. 18716, page 647, right column to page 648, left column.

Color photographic light-sensitive materials used in the present invention can be developed by the conventional methods described in RD. No. 17643, pages 28 and 29 and RD No. 18716, page 651, left to right columns.

The present invention will be described in detail below by way of its examples, but the invention is not limited to these examples.

EXAMPLE 1

Multiple layers having the compositions presented below were coated on a subbed triacetylcellulose film support to make a sample 101 as a multilayered color light-sensitive material.

(Compositions of layers)

The main materials used in the individual layers are classified as follows.

| | | | |
|---|---|---|---|
| ExC: | Cyan coupler | UV: | Ultraviolet absorbent |
| ExM: | Magenta coupler | HBS: | High-boiling point organic solvent |
| ExY: | Yellow coupler | H: | Gelatin hardener |
| ExS: | Sensitizing dye | | |

The number corresponding to each component indicates the coating amount in units of $g/m^2$. The coating amount of a silver halide is represented by the amount of silver. The coating amount of each sensitizing dye is represented in units of mols per mol of silver halide in the same layer.

(Sample 101)

1st layer (Antihalation layer)

| | | |
|---|---|---|
| Black colloidal silver | silver | 0.18 |
| Gelatin | | 1.40 |
| ExM-1 | | 0.18 |
| ExF-1 | | $2.0 \times 10^{-3}$ |
| HBS-1 | | 0.20 |

2nd layer (Interlayer)

| | | |
|---|---|---|
| Emulsion G | silver | 0.065 |
| 2,5-di-t-pentadecylhydroquinone | | 0.18 |
| ExC-2 | | 0.020 |
| UV-1 | | 0.060 |
| UV-2 | | 0.080 |
| UV-3 | | 0.10 |
| HBS-1 | | 0.10 |
| HBS-2 | | 0.020 |
| Gelatin | | 1.04 |

3rd layer (Low-speed red-sensitive emulsion layer)

| | | |
|---|---|---|
| Emulsion A | silver | 0.25 |
| Emulsion B | silver | 0.25 |
| ExS-1 | | $6.9 \times 10^{-5}$ |
| ExS-2 | | $1.8 \times 10^{-5}$ |
| ExS-3 | | $3.1 \times 10^{-4}$ |
| ExC-1 | | 0.17 |
| ExC-3 | | 0.030 |
| ExC-4 | | 0.10 |
| ExC-5 | | 0.020 |
| ExC-7 | | 0.0050 |
| ExC-8 | | 0.010 |
| Cpd-2 | | 0.025 |
| HBS-1 | | 0.10 |
| Gelatin | | 0.87 |

4th layer (Medium-speed red-sensitive emulsion layer)

| | | |
|---|---|---|
| Emulsion D | silver | 0.70 |
| ExS-1 | | $3.5 \times 10^{-4}$ |
| ExS-2 | | $1.6 \times 10^{-5}$ |
| ExS-3 | | $5.1 \times 10^{-4}$ |
| ExC-1 | | 0.13 |
| ExC-2 | | 0.060 |
| ExC-3 | | 0.0070 |
| ExC-4 | | 0.090 |
| ExC-5 | | 0.025 |
| ExC-7 | | 0.0010 |
| ExC-8 | | 0.0070 |
| Cpd-2 | | 0.023 |
| HBS-1 | | 0.10 |
| Gelatin | | 0.75 |

5th layer (High-speed red-sensitive emulsion layer)

| | | |
|---|---|---|
| Emulsion E | silver | 1.40 |
| ExS-1 | | $2.4 \times 10^{-4}$ |
| ExS-2 | | $1.0 \times 10^{-4}$ |
| ExS-3 | | $3.4 \times 10^{-4}$ |
| ExC-1 | | 0.12 |
| ExC-3 | | 0.045 |
| ExC-6 | | 0.020 |
| ExC-8 | | 0.025 |
| Cpd-2 | | 0.050 |
| HBS-1 | | 0.22 |

-continued (Sample 101)

| | | |
|---|---|---|
| HBS-2 | | 0.10 |
| Gelatin | | 1.20 |

6th layer (Interlayer)

| | | |
|---|---|---|
| Cpd-1 | | 0.10 |
| HBS-1 | | 0.50 |
| Gelatin | | 1.10 |

7th layer (Low-speed green-sensitive emulsion layer)

| | | |
|---|---|---|
| Emulsion C | silver | 0.35 |
| ExS-4 | | $3.0 \times 10^{-5}$ |
| ExS-5 | | $2.1 \times 10^{-4}$ |
| ExS-6 | | $8.0 \times 10^{-4}$ |
| ExM-1 | | 0.010 |
| ExM-2 | | 0.33 |
| ExM-3 | | 0.086 |
| ExY-1 | | 0.015 |
| HBS-1 | | 0.30 |
| HBS-3 | | 0.010 |
| Gelatin | | 0.73 |

8th layer (Medium-speed green-sensitive emulsion layer)

| | | |
|---|---|---|
| Emulsion D | silver | 0.80 |
| ExS-4 | | $3.2 \times 10^{-5}$ |
| ExS-5 | | $2.2 \times 10^{-4}$ |
| ExS-6 | | $8.4 \times 10^{-4}$ |
| ExM-2 | | 0.13 |
| ExM-3 | | 0.030 |
| ExY-1 | | 0.018 |
| HBS-1 | | 0.16 |
| HBS-3 | | $8.0 \times 10^{-3}$ |
| Gelatin | | 0.90 |

9th layer (High-speed green-sensitive emulsion layer)

| | | |
|---|---|---|
| Emulsion E | silver | 1.25 |
| ExS-4 | | $3.7 \times 10^{-5}$ |
| ExS-5 | | $8.1 \times 10^{-5}$ |
| ExS-6 | | $3.2 \times 10^{-4}$ |
| ExC-1 | | 0.010 |
| ExM-1 | | 0.030 |
| ExM-4 | | 0.040 |
| ExM-5 | | 0.019 |
| Cpd-3 | | 0.040 |
| HBS-1 | | 0.25 |
| HBS-2 | | 0.10 |
| Gelatin | | 1.44 |

10th layer (Yellow filter layer)

| | | |
|---|---|---|
| Yellow colloidal silver | silver | 0.030 |
| Cpd-1 | | 0.16 |
| HBS-1 | | 0.60 |
| Gelatin | | 0.60 |

11th layer (Low-speed blue-sensitive emulsion layer)

| | | |
|---|---|---|
| Emulsion C | silver | 0.18 |
| ExS-7 | | $8.6 \times 10^{-4}$ |
| ExY-1 | | 0.020 |
| ExY-2 | | 0.22 |
| ExY-3 | | 0.50 |
| ExY-4 | | 0.020 |
| HBS-1 | | 0.28 |
| Gelatin | | 1.10 |

12th layer (Medium-speed blue-sensitive emulsion layer)

| | | |
|---|---|---|
| Emulsion D | silver | 0.40 |
| ExS-7 | | $7.4 \times 10^{-4}$ |
| ExC-7 | | $7.0 \times 10^{-3}$ |
| ExY-2 | | 0.050 |
| ExY-3 | | 0.10 |
| HBS-1 | | 0.050 |
| Gelatin | | 0.78 |

13th layer (High-speed blue-sensitive emulsion layer)

| | | |
|---|---|---|
| Emulsion F | silver | 1.00 |
| ExS-7 | | $4.0 \times 10^{-4}$ |
| ExY-2 | | 0.10 |

-continued

| (Sample 101) | | |
|---|---|---|
| ExY-3 | | 0.10 |
| HBS-1 | | 0.070 |
| Gelatin | | 0.86 |
| 14th layer (1st protective layer) | | |
| Emulsion G | silver | 0.20 |
| UV-4 | | 0.11 |
| UV-5 | | 0.17 |
| HBS-1 | | $5.0 \times 10^{-2}$ |
| Gelatin | | 1.00 |
| 15th layer (2nd protective layer) | | |
| H-1 | | 0.40 |
| B-1 (diameter 1.7 μm) | | $5.0 \times 10^{-2}$ |
| B-2 (diameter 1.7 μm) | | 0.10 |
| B-3 | | 0.10 |
| S-1 | | 0.20 |
| Gelatin | | 1.20 |

In addition to the above components, to improve shelf stability, processability, a resistance to pressure, antiseptic and mildewproofing properties, antistatic properties, and coating properties, the individual layers contained W-1 to W-3, B-4 to B-6, F-1 to F-17, iron salt, and lead salt.

The emulsions A to G used are shown in Tables 1 and 2 below.

TABLE 1

| | Average AgI content (%) | Average grain size (μm) | Variation coefficient (%) relating to grain size | Diameter/ thickness ratio | Average number of dislocation lines per grain |
|---|---|---|---|---|---|
| Emulsion A | 2.0 | 0.35 | 18 | 5 | less than 5 |
| Emulsion B | 4.0 | 0.50 | 15 | 5 | " |
| Emulsion C | 2.0 | 0.50 | 16 | 5 | " |
| Emulsion D | 9.0 | 0.65 | 25 | 6 | " |
| Emulsion E | 9.0 | 0.85 | 25 | 5 | " |
| Emulsion F | 9.0 | 1.05 | 25 | 4 | " |
| Emulsion G | 1.0 | 0.07 | 15 | 1 | " |

TABLE 2

| Emulsion | Amount of gold sensitizer (mol/molAg) | Amount of sulfur sensitizer (mol/mogAg) | Amount of selenium sensitizer (mol/mogAg) |
|---|---|---|---|
| A | $1.9 \times 10^{-5}$ | $3.2 \times 10^{-5}$ | $3.1 \times 10^{-5}$ |
| B | $4.3 \times 10^{-6}$ | $1.2 \times 10^{-5}$ | $1.2 \times 10^{-5}$ |
| C | $4.5 \times 10^{-6}$ | $1.1 \times 10^{-5}$ | $3.9 \times 10^{-6}$ |
| D | $4.3 \times 10^{-6}$ | $1.2 \times 10^{-5}$ | $3.2 \times 10^{-6}$ |
| E | $2.0 \times 10^{-6}$ | $8.1 \times 10^{-6}$ | $1.35 \times 10^{-6}$ |
| F | $8.0 \times 10^{-7}$ | $2.3 \times 10^{-6}$ | $2.2 \times 10^{-7}$ |

The substances used are listed below.

ExC-1
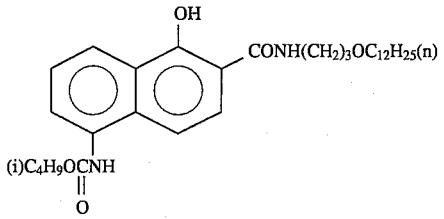
ExC-2
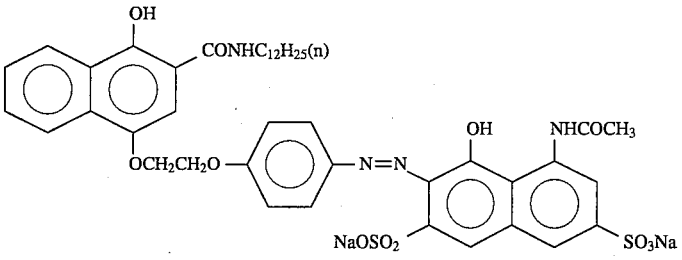
ExC-3
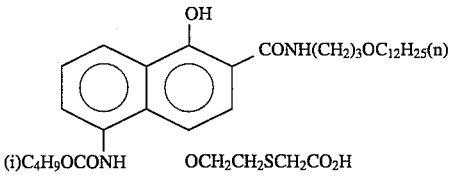
ExC-4
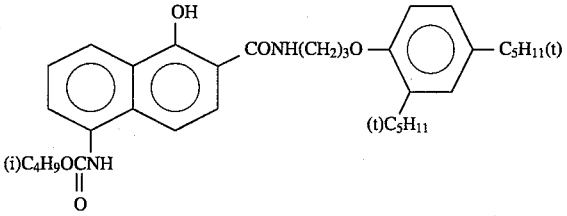
ExC-5
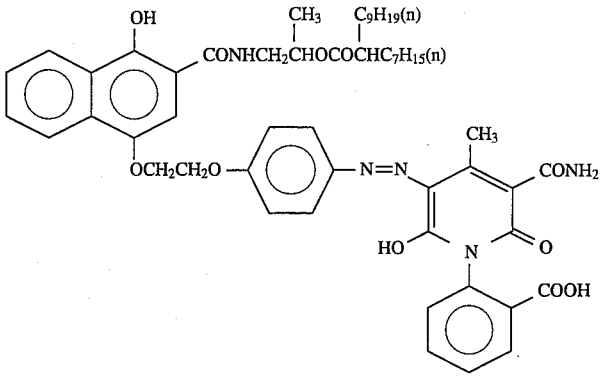
ExC-6
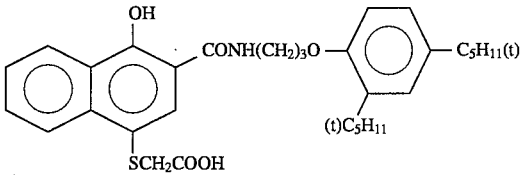

-continued
ExC-7
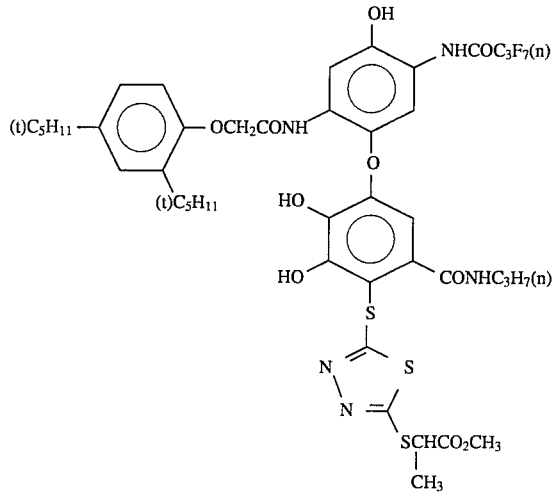
ExC-8
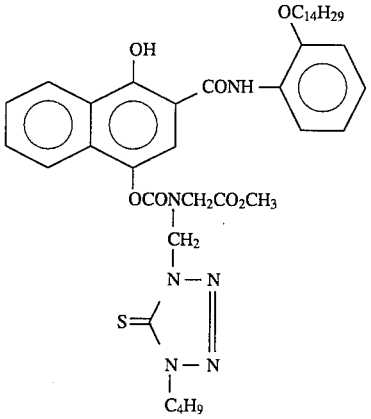
ExM-1
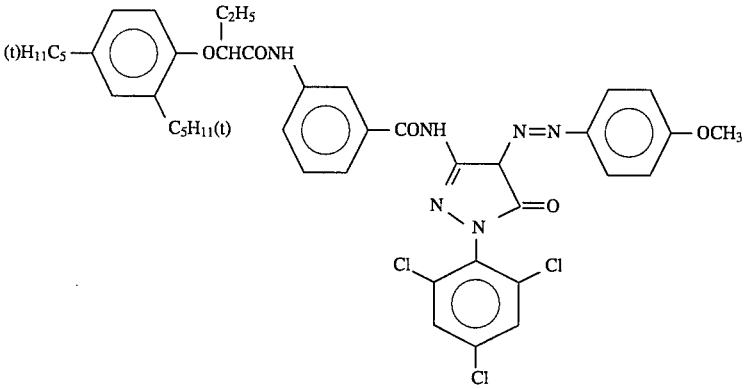
ExM-2
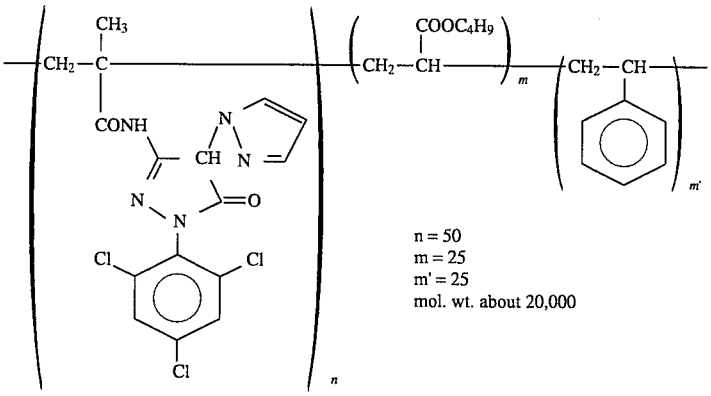

-continued
ExM-3
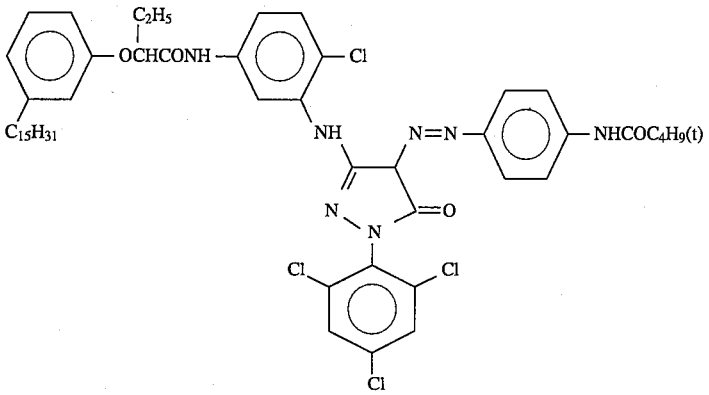
ExM-4
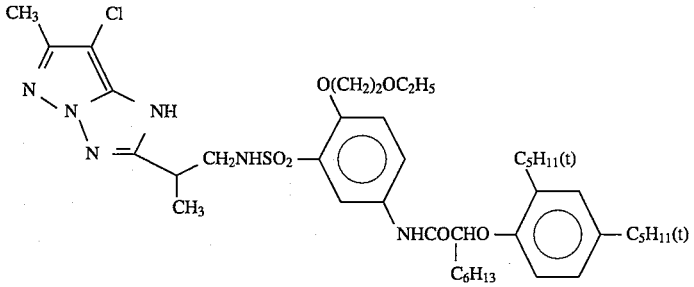
ExM-5
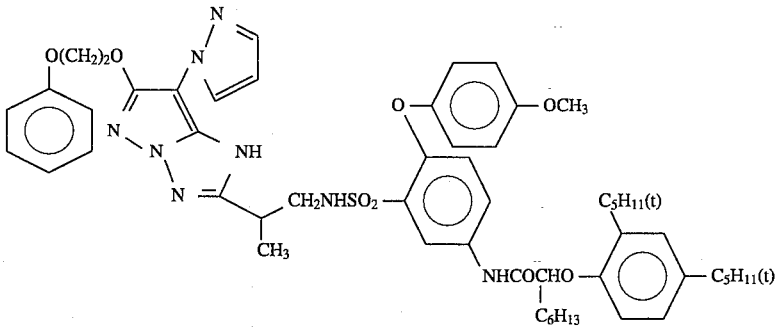
ExY-1
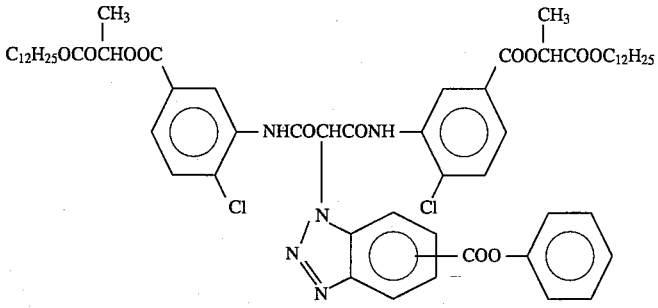
ExY-2
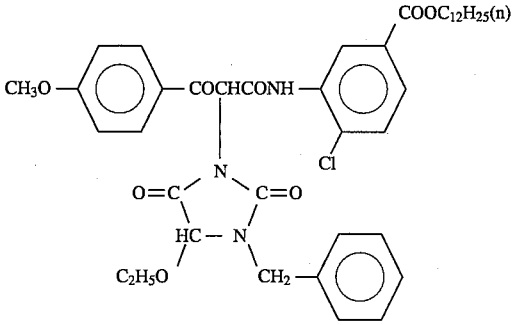

-continued
ExY-3
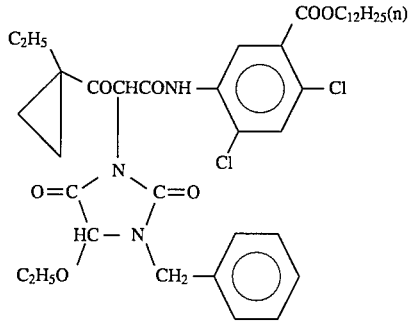
ExY-4
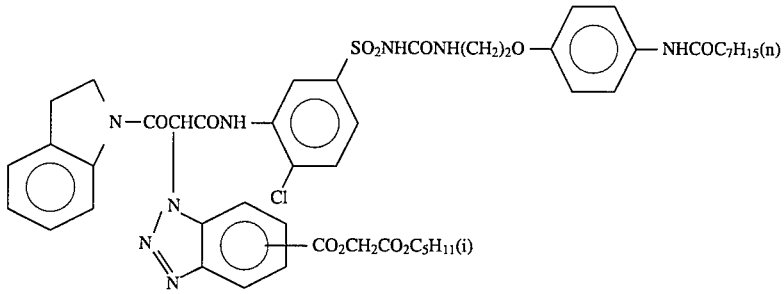
ExF-1
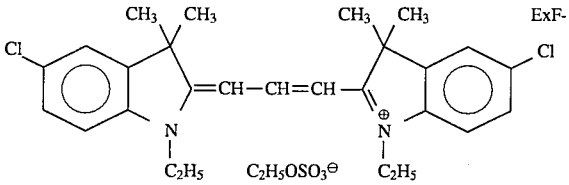
Cpd-1
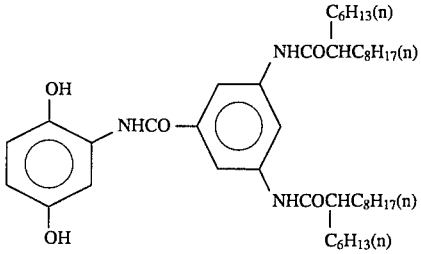
Cpd-2
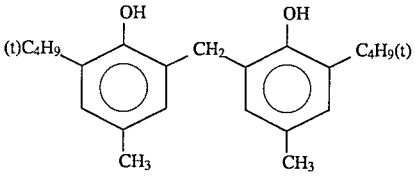
Cpd-3
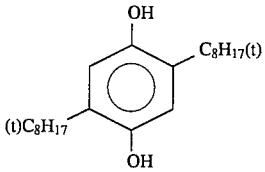
UV-1
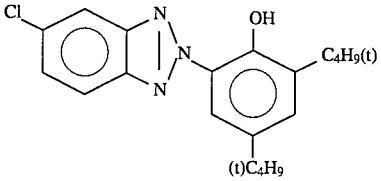
UV-2
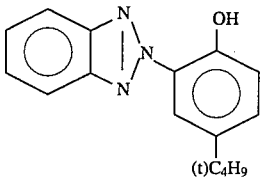
UV-3
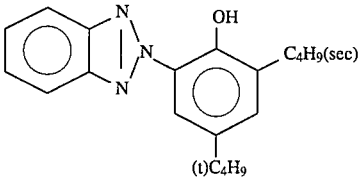
UV-4
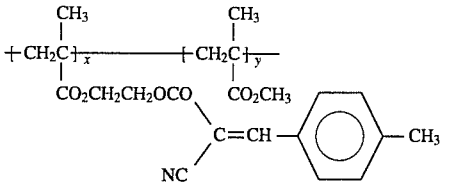
x:y = 70:30 (wt %)
UV-5
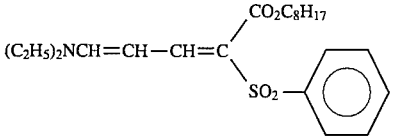
tricresylphosphate
HBS-1

-continued
di-n-butylphthalate
HBS-2
HBS-3
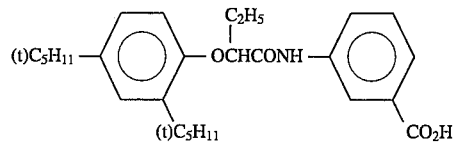
ExS-1
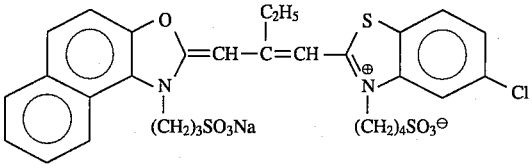
ExS-2
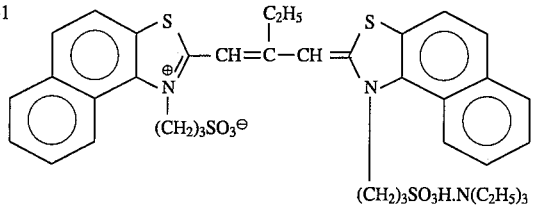
ExS-3
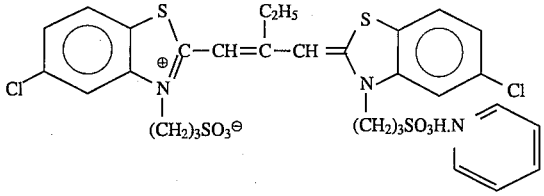
ExS-4
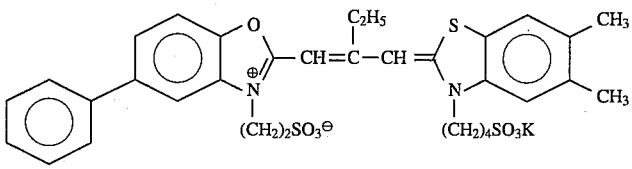
ExS-5
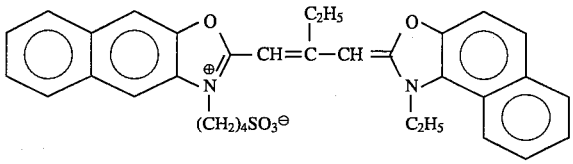
ExS-6
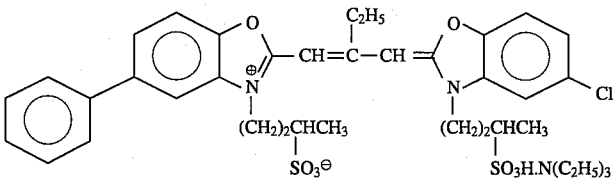
ExS-7
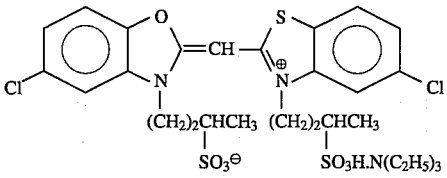
S-1
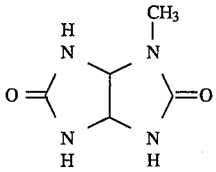
H-1
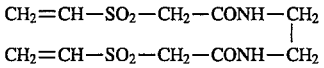
B-1
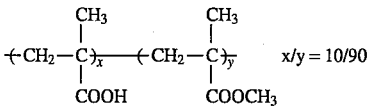
x/y = 10/90
B-2
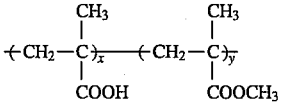
x/y = 40/60
B-3
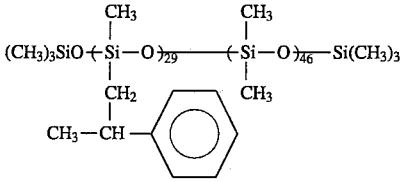

-continued
B-4
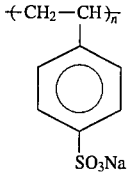
B-5
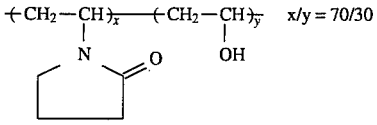
x/y = 70/30
B-6
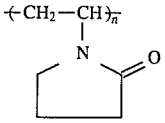
(mol. wt. about 10,000)
W-1
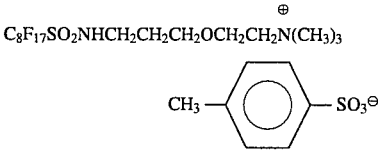
W-2
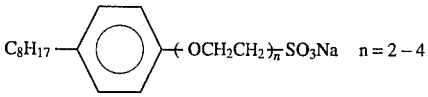
n = 2 – 4
W-3
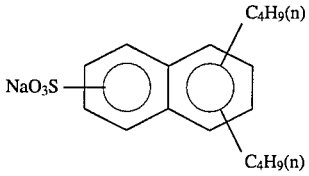
F-1
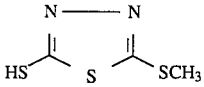
F-2
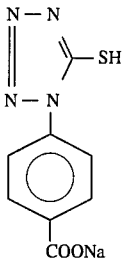
F-3
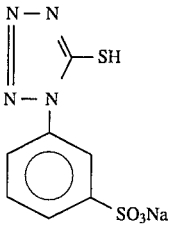
F-4
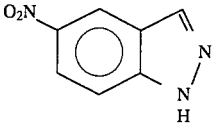
F-5
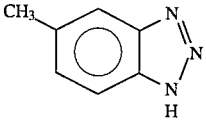
F-6
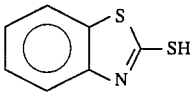
F-7
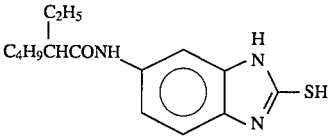
F-8
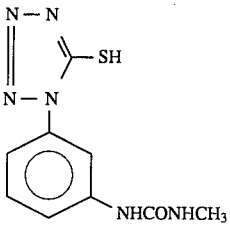
F-9
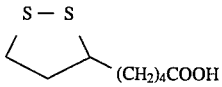
F-10
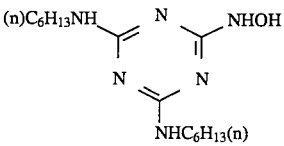
F-11
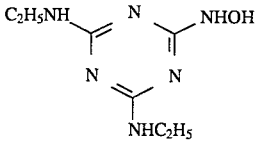
F-12
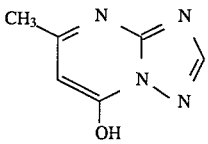

-continued

F-13

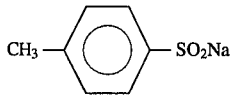

F-14

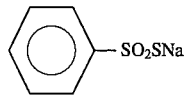

F-15

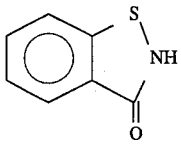

F-16

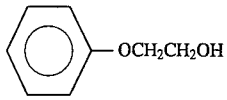

F-17

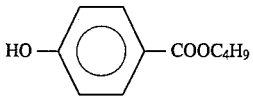

The emulsions A to G were prepared as follows.

(Preparation of emulsion A)

While 1,000 ml of an aqueous solution containing 6 g of gelatin with an average molecular weight of 10,000 and 4.5 g of KBr were stirred at 30° C., an aqueous $AgNO_3$ (7.3 g) solution and an aqueous KBr (5.3 g) solution were added to the solution by the double-jet method. Gelatin was added to the resultant solution, and the temperature was raised to 60° C. After the potential was controlled to 0 mV with respect to the saturated calomel electrode, an aqueous $AgNO_3$ (145.3 g) solution and an aqueous KBr solution (containing 2.9 mol % of KI) were added to the solution by the double-Jet method while the flow rates were accelerated. During the addition, the silver potential was kept at −20 mV with respect to the saturated calomel electrode. After the silver potential was controlled to −50 mV, an aqueous silver nitrate solution ($AgNO_3$ 60 g) and an aqueous KBr solution were added to the resultant solution over 10 minutes by the double-jet method while the flow rates were accelerated. During the addition, the silver potential was kept at −50 mV with respect to the saturated calomel electrode. After being desalted, the resultant emulsion was added with gelatin and the sensitizing dyes, and subjected to optimal gold-sulfur-selenium sensitization.

(Preparation of emulsion B)

While 1,000 ml of an aqueous solution containing 6 g of gelatin with an average molecular weight of 20,000 and 4.5 g of KBr were stirred at 40° C., an aqueous $AgNO_3$ (7.3 g) solution and an aqueous KBr (5.3 g) solution were added to the solution by the double-jet method. Gelatin was added to the resultant solution, and the temperature was raised to 65° C. After the potential was controlled to 0 mV with respect to the saturated calomel electrode, an aqueous $AgNO_3$ (145.3 g) solution and an aqueous KBr solution (containing 5.9 mol % of KI) were added to the solution by the double-jet method while the flow rates were accelerated. During the addition, the silver potential was kept at −20 mV with respect to the saturated calomel electrode. After the silver potential was controlled to −50 mV, an aqueous silver nitrate solution ($AgNO_3$ 60 g) and an aqueous KBr solution were added to the resultant solution over 10 minutes by the double-jet method while the flow rates were accelerated. During the addition, the silver potential was kept at −50 mV with respect to the saturated calomel electrode. After being desalted, the resultant emulsion was added with gelatin and the sensitizing dyes, and subjected to optimal gold-sulfur-selenium sensitization.

(Preparation of emulsion C)

While 1,000 ml of an aqueous solution containing 6 g of gelatin with an average molecular weight of 20,000 and 4.5 g of KBr were stirred at 40° C., an aqueous $AgNO_3$ (7.3 g) solution and an aqueous KBr (5.3 g) solution were added to the solution by the double-jet method. Gelatin was added to the resultant solution, and the temperature was raised to 65° C. After the potential was controlled to 0 mV with respect to the saturated calomel electrode, an aqueous $AgNO_3$ (145.3 g) solution and an aqueous KBr solution (containing 2.9 mol % of KI) were added to the solution by the double-Jet method while the flow rates were accelerated. During the addition, the silver potential was kept at −20 mV with respect to the saturated calomel electrode. After the silver potential was controlled to −80 mV, an aqueous silver nitrate solution ($AgNO_3$ 60 g) and an aqueous KBr solution were added to the resultant solution over 18 minutes by the double-jet method while the flow rates were accelerated. During the addition, the silver potential was kept at −80 mV with respect to the saturated calomel electrode. After being desalted, the resultant emulsion was added with gelatin and the sensitizing dyes, and subjected to optimal gold-sulfur-selenium sensitization.

(Preparation of emulsion D)

While 1,000 ml of an aqueous solution containing 7 g of gelatin with an average molecular weight of 20,000 and 4.5 g of KBr were stirred at 50° C., an aqueous $AgNO_3$ (7.3 g) solution and an aqueous KBr (5.3 g) solution were added to the solution by the double-jet method. Gelatin was added to the resultant solution, and the temperature was raised to 70° C. After the potential was controlled to 10 mV with respect to the saturated calomel electrode, an aqueous $AgNO_3$ (145.3 g) solution and an aqueous KBr solution (containing 13.2 mol % of KI) were added to the solution by the double-jet method while the flow rates were accelerated. During the addition, the silver potential was kept at −30 mV with respect to the saturated calomel electrode. After the silver potential was controlled to +20 mV, an aqueous silver nitrate solution ($AgNO_3$ 60 g) and an aqueous KBr solution were added to the resultant solution over 50 minutes by the double-jet method while the flow rates were accelerated. During the addition, the silver potential was kept at +20 mV with respect to the saturated calomel electrode. After being desalted, the resultant emulsion was added with gelatin and the sensitizing dyes, and subjected to optimal gold-sulfur-selenium sensitization.

(Preparation of emulsion E)

While 1,000 ml of an aqueous solution containing 8 g of gelatin with an average molecular weight of 20,000 and 4.5 g of KBr were stirred at 60° C., an aqueous $AgNO_3$ (7.3 g) solution and an aqueous KBr (5.3 g) solution were added to the solution by the double-jet method. Gelatin was added to the resultant solution, and the temperature was raised to 75°

C. After the potential was controlled to 20 mV with respect to the saturated calomel electrode, an aqueous $AgNO_3$ (145.3 g) solution and an aqueous KBr solution (containing 13.2 mol % of KI) were added to the solution by the double-jet method while the flow rates were accelerated. During the addition, the silver potential was kept at −20 mV with respect to the saturated calomel electrode. After the silver potential was controlled to −30 mV, an aqueous silver nitrate solution ($AgNO_3$ 60 g) and an aqueous KBr solution were added to the resultant solution over 50 minutes by the double-jet method while the flow rates were accelerated. During the addition, the silver potential was kept at −30 mV with respect to the saturated calomel electrode. After being desalted, the resultant emulsion was added with gelatin and the sensitizing dyes, and subjected to optimal gold-sulfurselenium sensitization.

(Preparation of emulsion F)

While 1,000 ml of an aqueous solution containing 10 g of gelatin with an average molecular weight of 30,000 and 4.5 g of KBr were stirred at 70° C., an aqueous $AgNO_3$ (7.3 g) solution and an aqueous KBr (5.3 g) solution were added to the solution by the double-jet method. Gelatin was added to the resultant solution, and the temperature was raised to 75° C. After the potential was controlled to 30 mV with respect to the saturated calomel electrode, an aqueous $AgNO_3$ (145.3 g) solution and an aqueous KBr solution (containing 13.2 mol % of KI) were added to the solution by the double-jet method while the flow rates were accelerated. During the addition, the silver potential was kept at −30 mV with respect to the saturated calomel electrode. After the silver potential was controlled to 0 mV, an aqueous silver nitrate solution ($AgNO_3$ 60 g) and an aqueous KBr solution were added to the resultant solution over 90 minutes by the double-jet method while the flow rates were accelerated. During the addition, the silver potential was kept at 0 mV with respect to the saturated calomel electrode. After being desalted, the resultant emulsion was added with gelatin and the sensitizing dyes, and subjected to optimal gold-sulfurselenium sensitization.

The emulsion G consisted of fine silver halide grains and was prepared in accordance with a conventional method.

The total amount of thiocyanate salt used in the preparation of the emulsions A to G, i.e., the total amount of thiocyanate salt contained in the sample 101 was $3\times10^{-3}$ mol/molAg.

A sample 102 was made following the same procedures as for the sample 101 except the emulsions A to F were changed to emulsions H to M shown in Table 3. The sample 102 contained $3\times10^{-3}$ mol/molAg of thiocyanate salt.

TABLE 3

| | Average AgI content (%) | Average grain size (μm) | Variation coefficient (%) relating to grain size | Diameter/ thickness ratio | Average number of dislocation lines per grain |
|---|---|---|---|---|---|
| Emulsion H | 2.0 | 0.35 | 18 | 5 | 50 or more |
| Emulsion I | 4.0 | 0.50 | 15 | 5 | " |
| Emulsion J | 2.0 | 0.50 | 16 | 5 | " |
| Emulsion K | 9.0 | 0.65 | 25 | 6 | " |
| Emulsion L | 9.0 | 0.85 | 25 | 5 | " |
| Emulsion M | 9.0 | 1.05 | 25 | 4 | " |

The emulsions H to M were prepared as follows.

(Preparation of emulsion H)

While 1,000 ml of an aqueous solution containing 6 g of gelatin with an average molecular weight of 10,000 and 4.5 g of KBr were stirred at 30° C., an aqueous $AgNO_3$ (7.3 g) solution and an aqueous KBr (5.3 g) solution were added to the solution by the double-jet method. Gelatin was added to the resultant solution, and the temperature was raised to 60° C. After the potential was controlled to 0 mV with respect to the saturated calomel electrode, an aqueous $AgNO_3$ (141.1 g) solution and an aqueous KBr solution were added to the solution by the double-Jet method while the flow rates were accelerated. During the addition, the silver potential was kept at −20 mV with respect to the saturated calomel electrode. An aqueous silver nitrate solution ($AgNO_3$ 4.2 g) and an aqueous KI solution (4.1 g) were added to the resultant solution over five minutes. Thereafter, the silver potential was controlled to −50 mV, and an aqueous silver nitrate solution ($AgNO_3$ 60 g) and an aqueous KBr solution were added to the resultant solution over 10 minutes by the double-jet method while the flow rates were accelerated. During the addition, the silver potential was kept at −50 mV with respect to the saturated calomel electrode. After being desalted, the resultant emulsion was added with gelatin and the sensitizing dyes, and subjected to optimal gold-sulfurselenium sensitization.

(Preparation of emulsion I)

While 1,000 ml of an aqueous solution containing 6 g of gelatin with an average molecular weight of 20,000 and 4.5 g of KBr were stirred at 40° C., an aqueous $AgNO_3$ (7.3 g) solution and an aqueous KBr (5.3 g) solution were added to the solution by the double-jet method. Gelatin was added to the resultant solution, and the temperature was raised to 65° C. After the potential was controlled to 0 mV with respect to the saturated calomel electrode, an aqueous $AgNO_3$ (141.1 g) solution and an aqueous KBr solution (containing 3.0 mol % of KI) were added to the solution by the double-jet method while the flow rates were accelerated. During the addition, the silver potential was kept at −20 mV with respect to the saturated calomel electrode. An aqueous silver nitrate solution ($AgNO_3$ 4.2 g) and an aqueous KI solution (4.1 g) were added to the resultant solution over one minute. Thereafter, the silver potential was controlled to −50 mV, and an aqueous silver nitrate solution ($AgNO_3$ 60 g) and an aqueous KBr solution were added to the resultant solution over 10 minutes by the double-jet method while the flow rates were accelerated. During the addition, the silver potential was kept at −50 mV with respect to the saturated calomel electrode. After being desalted, the resultant emulsion was added with gelatin and the sensitizing dyes, and subjected to optimal gold-sulfur-selenium sensitization.

(Preparation of emulsion J)

While 1,000 ml of an aqueous solution containing 6 g of gelatin with an average molecular weight of 20,000 and 4.5 g of KBr were stirred at 40° C., an aqueous $AgNO_3$ (7.3 g) solution and an aqueous KBr (5.3 g) solution were added to the solution by the double-jet method. Gelatin was added to the resultant solution, and the temperature was raised to 65°

C. After the potential was controlled to 0 mV with respect to the saturated calomel electrode, an aqueous $AgNO_3$ (145.3 g) solution and an aqueous KBr solution were added to the solution by the double-Jet method while the flow rates were accelerated. During the addition, the silver potential was kept at −20 mV with respect to the saturated calomel electrode. The silver potential was controlled to −80 mV, and an aqueous KI solution (4.1 g) was added to the resultant solution over 10 minutes. Thereafter, an aqueous silver nitrate solution ($AgNO_3$ 60 g) and an aqueous KBr solution were added to the resultant solution over 18 minutes by the double-jet method while the flow rates were accelerated. During the addition, the silver potential was kept at −80 mV with respect to the saturated calomel electrode. After being desalted, the resultant emulsion was added with gelatin and the sensitizing dyes, and subjected to optimal gold-sulfur-selenium sensitization.

(Preparation of emulsion K)

While 1,000 ml of an aqueous solution containing 7 g of gelatin with an average molecular weight of 20,000 and 4.5 g of KBr were stirred at 50° C., an aqueous $AgNO_3$ (7.3 g) solution and an aqueous KBr (5.3 g) solution were added to the solution by the double-jet method. Gelatin was added to the resultant solution, and the temperature was raised to 70° C. After the potential was controlled to 10 mV with respect to the saturated calomel electrode, an aqueous $AgNO_3$ (145.3 g) solution and an aqueous KBr solution (containing 8.2 mol % of KI) were added to the solution by the double-jet method while the flow rates were accelerated. During the addition, the silver potential was kept at −30 mV with respect to the saturated calomel electrode. An aqueous silver nitrate solution ($AgNO_3$ 8.7 g) and an aqueous KI solution (7.1 g) were added to the resultant solution over five minutes. Thereafter, the silver potential was controlled to +20 mV, and an aqueous silver nitrate solution ($AgNO_3$ 51.3 g) and an aqueous KBr solution were added to the resultant solution over 50 minutes by the double-jet method while the flow rates were accelerated. During the addition, the silver potential was kept at +20 mV with respect to the saturated calomel electrode. After being desalted, the resultant emulsion was added with gelatin and the sensitizing dyes, and subjected to optimal gold-sulfur-selenium sensitization.

(Preparation of emulsion L)

While 1,000 ml of an aqueous solution containing 8 g of gelatin with an average molecular weight of 20,000 and 4.5 g of KBr were stirred at 60° C., an aqueous $AgNO_3$ (7.3 g) solution and an aqueous KBr (5.3 g) solution were added to the solution by the double-jet method. Gelatin was added to the resultant solution, and the temperature was raised to 75° C. After the potential was controlled to 20 mV with respect to the saturated calomel electrode, an aqueous $AgNO_3$ (145.3 g) solution and an aqueous KBr solution (containing 7.0 mol % of KI) were added to the solution by the double-jet method while the flow rates were accelerated. During the addition, the silver potential was kept at −20 mV with respect to the saturated calomel electrode. An aqueous silver nitrate solution ($AgNO_3$ 9.0 g) and an aqueous KI solution (8.8 g) were added to the resultant solution over 20 minutes. Thereafter, the silver potential was controlled to −30 mV, and an aqueous silver nitrate solution ($AgNO_3$ 51 g) and an aqueous KBr solution were added to the solution over 50 minutes by the double-jet method while the flow rates were accelerated. During the addition, the silver potential was kept at −30 mV with respect to the saturated calomel electrode. After being desalted, the resultant emulsion was added with gelatin and the sensitizing dyes, and subjected to optimal gold-sulfur-selenium sensitization.

(Preparation of emulsion M)

While 1,000 ml of an aqueous solution containing 10 g of gelatin with an average molecular weight of 30,000 and 4.5 g of KBr were stirred at 70° C., an aqueous $AgNO_3$ (7.3 g) solution and an aqueous KBr (5.3 g) solution were added to the solution by the double-jet method. Gelatin was added to the resultant solution, and the temperature was raised to 75° C. After the potential was controlled to 30 mV with respect to the saturated calomel electrode, an aqueous $AgNO_3$ (139.2 g) solution and an aqueous KBr solution (containing 9.0 mol % of KI) were added to the solution by the double-jet method while the flow rates were accelerated. During the addition, the silver potential was kept at −30 mV with respect to the saturated calomel electrode. An aqueous silver nitrate solution ($AgNO_3$ 6.1 g) and an aqueous KI solution (6.0 g) were added to the resultant solution over five minutes. Thereafter, the silver potential was controlled to 0 mV, and an aqueous silver nitrate solution ($AgNO_3$ 60 g) and an aqueous KBr solution were added to the solution over 90 minutes by the double-jet method while the flow rates were accelerated. During the addition, the silver potential was kept at 0 mV with respect to the saturated calomel electrode. After being desalted, the resultant emulsion was added with gelatin and the sensitizing dyes, and subjected to optimal gold-sulfur-selenium sensitization.

A sample 103 was made following the same procedures as for the sample 101 except $1\times10^{-5}$ mol/molAg, as a total silver amount, of sodium palladium(II) chloride was added to the sixth layer (interlayer).

A sample 104 was made following the same procedures as for the sample 102 except $1\times10^{-5}$ mol/molAg, as a total silver amount, of sodium palladium(II) chloride was added to the sixth layer (interlayer).

A sample 105 was made following the same procedures as for the sample 101 except $1\times10^{-4}$ mol/molAg, as a total silver amount, of sodium palladium(II) chloride was added to the sixth layer (interlayer).

A sample 106 was made following the same procedures as for the sample 102 except $1\times10^{-4}$ mol/molAg, as a total silver amount, of sodium palladium(II) chloride was added to the sixth layer (interlayer).

Each of the samples 101 to 106 was formed into a 135-format cartridge of 24 exposures, and moisture-conditioned at a temperature of 25° C. and a relative humidity of 60%. Thereafter, these samples were placed in transparent cartridge cases and perfectly light-shielding cartridge cases in a dark place.

The ratio of the film area loaded in the cartridge so as to be shielded from light to the film area extracted from a film extraction portion was 1:0.05.

One group of these samples was irradiated with light of 10,000 lux for 24 hours and preserved, together with the other group not irradiated with light, at 60° C. for three days. Thereafter, the samples were processed under the following conditions by using an automatic developing machine.

The processing steps and the compositions of the processing solutions were as follows.

(Processing Steps)

| Step | Time | Temperature | Quantity of replenisher* | Tank volume |
|---|---|---|---|---|
| Color development | 3 min. 05 sec. | 38.0° C. | 600 ml | 17 l |
| Bleaching | 50 sec. | 38.0° C. | 140 ml | 5 l |
| Bleach- | 50 sec. | 38.0° C. | — | 5 l |

-continued (Processing Steps)

| Step | Time | Temperature | Quantity of replenisher* | Tank volume |
|---|---|---|---|---|
| fixing | | | | |
| Fixing | 50 sec. | 38.0° C. | 420 ml | 5 l |
| Washing | 30 sec. | 38.0° C. | 980 ml | 3 l |
| Stabilization (1) | 20 sec. | 38.0° C. | — | 3 l |
| Stabilization (2) | 20 sec. | 38.0° C. | 560 ml | 3 l |
| Drying | 1 min. | 60° C. | | |

*The quantity of replenisher is represented by a value per 1 $m^2$ of a light-sensitive material.

The stabilizing solution was counter-flowed from (2) to (1), and the overflow solution of washing water was introduced entirely to the fixing bath. In addition, switches were provided in the upper portions of the bleaching tank and the fixing tank of the automatic developing machine so that the overflow solution produced by supply of replenishers to the bleaching and fixing tanks was flowed entirely to the bleach-fixing bath. Note that the quantities of the developing solution, the bleaching solution, the bleach-fixing solution, and the fixing solution, which were carried over to the bleaching step, the bleach-fixing step, the fixing step, and the washing step, were 65 ml, 50 ml, 50 ml, and 50 ml, respectively. Note also that the crossover time of each step was six seconds, and this time was included in the processing time of each previous step.

Each replenisher was the same as the corresponding tank solution.

The compositions of the individual processing solutions are shown below.

| | (g) |
|---|---|
| (Color developing solution) | |
| Diethylenetriaminepentaacetic acid | 2.0 |
| 1-hydroxyethylidene-1,1-diphosphonic acid | 3.3 |
| Sodium sulfite | 3.9 |
| Potassium carbonate | 37.5 |
| Potassium bromide | 1.4 |
| Potassium iodide | 1.3 mg |
| Hydroxylamine sulfate | 2.4 |
| 2-methyl-4-[N-ethyl-N-(β-hydroxylethyl)amino]-aniline sulfate | 45 |

-continued

| | (g) |
|---|---|
| Water to make | 1.0 l |
| pH | 10.05 |
| (Bleaching solution) | |
| Ferric ammonium 1,3-diaminopropanetetraacetate monohydrate | 130.0 |
| Ammonium bromide | 80.0 |
| Ammonium nitrate | 15.0 |
| Hydroxyacetic acid | 50.0 |
| Acetic acid | 40.0 |
| Water to make | 1.0 l |
| pH (controlled by ammonia water) | 4.4 |
| (Bleach-fixing solution) | |
| A 15:85 (volume ratio) solution mixture of the above bleaching solution and the following fixing solution. (pH 7.0) | |
| (Fixing solution) | |
| Ammonium sulfite | 19.0 |
| Ammonium thiosulfate aqueous solution (700 g/l) | 280.0 ml |
| Imidazole | 15.0 |
| Ethylenediaminetetraacetic acid | 15.0 |
| Water to make | 1.0 l |
| pH (controlled by ammonia water and acetic acid) | 7.4 |
| (Washing solution) | |

Tap water was supplied to a mixed-bed column filled with an H type strongly acidic cation exchange resin (Amberlite IR-120B: available from Rohm & Haas Co.) and an OH type strongly basic anion exchange resin (Amberlite IR-400) to set the concentrations of calcium and magnesium to be 3 mg/l or less. Subsequently, 20 mg/l of isocyanuric acid dichloride sodium salt and 150 mg/l of sodium sulfate were added. The pH of the solution ranged from 6.5 to 7.5.

| (Stabilizing solution) | (g) |
|---|---|
| Sodium p-toluenesulfinate | 0.03 |
| Polyoxyethylene-p-monononylphenylether (average polymerization degree 10) | 0.2 |
| Disodium ethylenediaminetetraacetate | 0.05 |
| 1,2,4-triazole | 1.3 |
| 1,4-bis(1,2,4-triazol-1-ylmethyl) piperazine | 0.75 |
| Water to make | 1.0 l |
| pH | 8.5 |

The results are summarized in Table 4 below.

TABLE 4

| Sample name | Cartridge case | Irradiation with light | Increase in fog | | |
|---|---|---|---|---|---|
| | | | Blue-sensitive layer | Green-sensitive layer | Red-sensitive layer |
| 101 (Comparative example) | Transparent | Irradiated | 0.14 | 0.16 | 0.13 |
| 101 (Comparative example) | " | None | 0.07 | 0.08 | 0.08 |
| 101 (Comparative example) | Light-shielding | Irradiated | 0.07 | 0.08 | 0.08 |
| 101 (Comparative example) | " | None | 0.07 | 0.08 | 0.08 |
| 102 (Comparative example) | Transparent | Irradiated | 0.28 | 0.43 | 0.33 |
| 102 (Comparative | " | None | 0.09 | 0.10 | 0.11 |

TABLE 4-continued

| Sample name | Cartridge case | Irradiation with light | Increase in fog | | |
|---|---|---|---|---|---|
| | | | Blue-sensitive layer | Green-sensitive layer | Red-sensitive layer |
| example) | | | | | |
| 102 (Comparative example) | Light-shielding | Irradiated | 0.09 | 0.10 | 0.11 |
| 102 (Comparative example) | " | None | 0.09 | 0.10 | 0.11 |
| 103 (Comparative example) | Transparent | Irradiated | 0.14 | 0.15 | 0.13 |
| 103 (Comparative example) | " | None | 0.07 | 0.08 | 0.08 |
| 103 (Comparative example) | Light-shielding | Irradiated | 0.07 | 0.08 | 0.08 |
| 103 (Comparative example | " | None | 0.07 | 0.08 | 0.08 |
| 104 (Comparative example) | Transparent | Irradiated | 0.28 | 0.41 | 0.30 |
| 104 (Comparative example) | " | None | 0.09 | 0.10 | 0.11 |
| 104 (Comparative example) | Light-shielding | Irradiated | 0.09 | 0.10 | 0.11 |
| 104 (Comparative example) | " | None | 0.09 | 0.10 | 0.11 |
| 105 (Comparative example | Transparent | Irradiated | 0.07 | 0.08 | 0.08 |
| 105 (Comparative example | " | None | 0.07 | 0.08 | 0.08 |
| 105 (Comparative example | Light-shielding | Irradiated | 0.07 | 0.08 | 0.08 |
| 105 (Comparative example | " | None | 0.07 | 0.08 | 0.08 |
| 106 (Present invention) | Transparent | Irradiated | 0.06 | 0.06 | 0.05 |
| 106 (Present invention) | " | None | 0.06 | 0.06 | 0.05 |
| 106 (Comparative example) | Light-shielding | Irradiated | 0.06 | 0.06 | 0.05 |
| 106 (Comparative example) | " | None | 0.06 | 0.06 | 0.05 |

Table 4 reveals the following. Abnormal fog occurred in each sample irradiated with light in the transparent case, and the degree of fog increased when tabular grains having dislocation lines were used. In the sample 104 in which Pd salt was added to the sixth layer (interlayer) in an amount of 1/15 mol per mol of thiocyanate contained in a portion that could be irradiated with light, fog against irradiation with light in the transparent case was not much improved. However, fog in the sample 106 added with 2/3 mol of Pd salt was improved significantly. This effect of the Pd salt on fog against irradiation with light in the transparent case was significant when tabular grains having dislocation lines were used.

EXAMPLE 2

A sample 107 was made following the same procedures as for the sample 106 except 0.07, 0.015, and 0.02 g/m$^2$ of Cpd-3 were added to the 11th, 12th, and 13th layers, respectively. The sample 106 was processed following the same procedures as in Example 1 and subjected to the same experiment and processing. The results are shown in Table 5 below.

TABLE 5

| Sample name | Cartridge case | Irradiation with light | Increase in fog | | |
|---|---|---|---|---|---|
| | | | Blue-sensitive layer | Green-sensitive layer | Red-sensitive layer |
| 106 | Transparent | Irradiated | 0.06 | 0.06 | 0.05 |
| 107 | Transparent | " | 0.04 | 0.04 | 0.05 |

It is apparent from Table 5 that a hydroquinone derivative known as a halogen gas scavenger contributed to a reduction in abnormal fog.

EXAMPLE 3

The sample 102 was subjected to the experiment and the processing following the same procedures as in Example 1 under different moisture conditioning conditions. The results are summarized in Table 7 below.

TABLE 6

| Sample name | Conditions of moisture conditioning | Cartridge case | Irradiation with light | Increase in fog | | |
|---|---|---|---|---|---|---|
| | | | | Blue-sensitive layer | Green-sensitive layer | Red-sensitive layer |
| 102 | 25° C./60% | Transparent | Irradiated | 0.28 | 0.43 | 0.33 |
| " | 25° C./70% | " | " | 0.35 | 0.58 | 0.39 |
| " | 25° C./50% | " | " | 0.16 | 0.17 | 0.18 |
| " | 25° C./40% | " | " | 0.10 | 0.10 | 0.07 |
| " | 25° C./30% | " | " | 0.08 | 0.08 | 0.06 |

Table 6 demonstrates that abnormal fog did not occur so much when the humidity in the cartridge case was low and hence the effect of the present invention was significant when the humidity was 55% or more.

What is claimed is:

1. An encased photographic material comprising:

a silver halide light-sensitive material including at least one silver halide emulsion layer on a support, said emulsion layer containing gold-, sulfur- and selenium-sensitized silver halide grains and a thiocyanate salt therein, at least 60% of a total projected area of said silver halide grains being occupied by tabular grains having an aspect ratio of 3 or more, said tabular grains having on an average 10 or more dislocation lines per grain;

a lightproof container containing said light-sensitive material such that an end portion of said light-sensitive material is positioned outside said lightproof container, and that a gas can pass between an inside and an outside of said lightproof container;

a light-transmitting case encasing and sealing said light-proof container, wherein a relative humidity inside said light-transmitting case is 55% or more at 25° C.; and a hydrogen cyanide gas scavenger comprising an organic or an inorganic palladium compound present inside said case in an amount of 1/10 mole or more per mole of thiocyanate salt contained in said end portion of said light-sensitive material, said hydrogen cyanide gas scavenger being present in a surface protective layer, an interlayer or an antihalation layer of said light-sensitive material.

2. The encased photographic material according to claim 1, further comprising a halogen gas scavenger inside said case.

3. The encased photographic material according to claim 2, wherein said halogen gas scavenger is present in said light-sensitive material.

4. The encased photographic material according to claim 3, wherein said halogen gas scavenger is present in an amount of 0.05 to 1 g/m$^2$.

5. The encased photographic material according to claim 1, wherein said light-sensitive material is a color photographic material.

6. The encased photographic material according to claim 1, wherein said hydrogen cyanide gas scavenger is present in an amount of ½ to 100 moles more per mole of thiocyanate salt contained in said end portion of said light-sensitive material.

7. The encased photographic material according to claim 1, wherein said hydrogen cyanide gas scavenger is present in an amount of 1 to 10 moles more per mole of thiocyanate salt contained in said end portion of said light-sensitive material.

8. The encased photographic material according to claim 1, wherein at least 80% of a total projected area of said silver halide grains are occupied by said tabular grains.

9. The encased photographic material according to claim 1, wherein said tabular grains have on an average 20 or more dislocation lines per grain.

10. The encased photographic material according to claim 1, wherein a relative humidity inside said light-transmitting case is 55% to 70% at 25° C.

11. The encased photographic material according to claim 1, wherein a relative humidity inside said light-transmitting case is 55% to 65% at 25° C.

12. The encased photographic material according to claim 1, wherein said dislocation lines are present at a peripheral region of each tabular grain.

13. The encased photographic material according to claim 1, wherein the hydrogen cyanide gas scavenger is present in the surface protective layer of said light-sensitive material.

14. The encased photographic material according to claim 1, wherein the hydrogen cyanide gas scavenger is present in the interlayer of said light-sensitive material.

15. The encased photographic material according to claim 1, wherein the hydrogen cyanide gas scavenger is present in the antihalation layer of said light-sensitive material.

* * * * *